US008401410B2

(12) United States Patent
Takura

(10) Patent No.: US 8,401,410 B2
(45) Date of Patent: Mar. 19, 2013

(54) IMAGE FORMING APPARATUS

(75) Inventor: Keizo Takura, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 679 days.

(21) Appl. No.: 12/490,081

(22) Filed: Jun. 23, 2009

(65) Prior Publication Data

US 2009/0317149 A1 Dec. 24, 2009

(30) Foreign Application Priority Data

Jun. 24, 2008 (JP) ..... 2008-165072
Jun. 18, 2009 (JP) ..... 2009-145443

(51) Int. Cl.
*G03G 15/00* (2006.01)

(52) U.S. Cl. ..... 399/49; 399/301

(58) Field of Classification Search ..... 399/301, 399/45, 59, 60, 72, 49
See application file for complete search history.

(56) References Cited

U.S. PATENT DOCUMENTS

2003/0052958 A1* 3/2003 Shinohara ..... 347/116
2006/0127114 A1* 6/2006 Mizuno ..... 399/49

FOREIGN PATENT DOCUMENTS

JP 2003-054078 A 2/2003

* cited by examiner

*Primary Examiner* — Walter L Lindsay, Jr.
*Assistant Examiner* — Barnabas Fekete
(74) *Attorney, Agent, or Firm* — Canon USA, Inc., IP Division

(57) ABSTRACT

An image forming apparatus includes a control unit configured to cause an image forming unit to form an adjustment image on an image bearing member, and a detection unit configured to detect the adjustment image, wherein the control unit controls gradation for forming an image by the image forming unit based on a detection result provided by the detection unit, and wherein, when causing the image forming unit to form a first adjustment image on the image bearing member at a photosensitive member and to subsequently form a second adjustment image that is different from the first adjustment image, the control unit causes the image forming unit to form the second adjustment image at a position different from a position for forming the first adjustment image in a longitudinal direction of the photosensitive member.

18 Claims, 16 Drawing Sheets

| | | | | | | | | | | | |
|---|---|---|---|---|---|---|---|---|---|---|---|
| 40% | 14% | 0% | 40% | 14% | 0% | 40% | 14% | 0% | 40% | 14% | 0% |
| 44% | 16% | 1% | 44% | 16% | 1% | 44% | 16% | 1% | 44% | 16% | 1% |
| 48% | 18% | 2% | 48% | 18% | 2% | 48% | 18% | 2% | 48% | 18% | 2% |
| 52% | 20% | 3% | 52% | 20% | 3% | 52% | 20% | 3% | 52% | 20% | 3% |
| 56% | 22% | 4% | 56% | 22% | 4% | 56% | 22% | 4% | 56% | 22% | 4% |
| 60% | 24% | 5% | 60% | 24% | 5% | 60% | 24% | 5% | 60% | 24% | 5% |
| 64% | 26% | 6% | 64% | 26% | 6% | 64% | 26% | 6% | 64% | 26% | 6% |
| 68% | 28% | 7% | 68% | 28% | 7% | 68% | 28% | 7% | 68% | 28% | 7% |
| 76% | 30% | 8% | 76% | 30% | 8% | 76% | 30% | 8% | 76% | 30% | 8% |
| 84% | 32% | 9% | 84% | 32% | 9% | 84% | 32% | 9% | 84% | 32% | 9% |
| 92% | 34% | 10% | 92% | 34% | 10% | 92% | 34% | 10% | 92% | 34% | 10% |
| 100% | 36% | 12% | 100% | 36% | 12% | 100% | 36% | 12% | 100% | 36% | 12% |

| | | | | | | | | | | | |
|---|---|---|---|---|---|---|---|---|---|---|---|
| 0% | 14% | 40% | 0% | 14% | 40% | 0% | 14% | 40% | 0% | 14% | 56% |
| 1% | 16% | 44% | 1% | 16% | 44% | 1% | 16% | 44% | 1% | 16% | 60% |
| 2% | 18% | 48% | 2% | 18% | 48% | 2% | 18% | 48% | 2% | 18% | 64% |
| 3% | 20% | 52% | 3% | 20% | 52% | 3% | 20% | 52% | 3% | 20% | 68% |
| 4% | 22% | 56% | 4% | 22% | 56% | 4% | 22% | 56% | 4% | 24% | 72% |
| 5% | 24% | 60% | 5% | 24% | 60% | 5% | 24% | 60% | 5% | 28% | 76% |
| 6% | 26% | 64% | 6% | 26% | 64% | 6% | 26% | 64% | 6% | 32% | 80% |
| 7% | 28% | 68% | 7% | 28% | 68% | 7% | 28% | 68% | 7% | 36% | 84% |
| 8% | 30% | 76% | 8% | 30% | 76% | 8% | 30% | 76% | 8% | 40% | 88% |
| 9% | 32% | 84% | 9% | 32% | 84% | 9% | 32% | 84% | 9% | 44% | 92% |
| 10% | 34% | 92% | 10% | 34% | 92% | 10% | 34% | 92% | 10% | 48% | 96% |
| 12% | 36% | 100% | 12% | 36% | 100% | 12% | 36% | 100% | 12% | 52% | 100% |

FIG.13

P

| Black | Yellow | Magenta | Cyan | Black | Yellow | Magenta | Cyan | Black | Yellow | Magenta | Cyan |
|---|---|---|---|---|---|---|---|---|---|---|---|
| 40% | 40% | 40% | 40% | 14% | 14% | 14% | 14% | 0% | 0% | 0% | 0% |
| 44% | 44% | 44% | 44% | 16% | 16% | 16% | 16% | 1% | 1% | 1% | 1% |
| 48% | 48% | 48% | 48% | 18% | 18% | 18% | 18% | 2% | 2% | 2% | 2% |
| 52% | 52% | 52% | 52% | 20% | 20% | 20% | 20% | 3% | 3% | 3% | 3% |
| 56% | 56% | 56% | 56% | 22% | 22% | 22% | 22% | 4% | 4% | 4% | 4% |
| 60% | 60% | 60% | 60% | 24% | 24% | 24% | 24% | 5% | 5% | 5% | 5% |
| 64% | 64% | 64% | 64% | 26% | 26% | 26% | 26% | 6% | 6% | 6% | 6% |
| 68% | 68% | 68% | 68% | 28% | 28% | 28% | 28% | 7% | 7% | 7% | 7% |
| 76% | 76% | 76% | 76% | 30% | 30% | 30% | 30% | 8% | 8% | 8% | 8% |
| 84% | 84% | 84% | 84% | 32% | 32% | 32% | 32% | 9% | 9% | 9% | 9% |
| 92% | 92% | 92% | 92% | 34% | 34% | 34% | 34% | 10% | 10% | 10% | 10% |
| 100% | 100% | 100% | 100% | 36% | 36% | 36% | 36% | 12% | 12% | 12% | 12% |

COLOR GRADATION PATCHES FOR FIRST GRADATION EXPRESSION METHOD

| Cyan | Magenta | Yellow | Black | Cyan | Magenta | Yellow | Black | Cyan | Magenta | Yellow | Black |
|---|---|---|---|---|---|---|---|---|---|---|---|
| 0% | 0% | 0% | 0% | 14% | 14% | 14% | 14% | 56% | 56% | 56% | 56% |
| 1% | 1% | 1% | 1% | 16% | 16% | 16% | 16% | 60% | 60% | 60% | 60% |
| 2% | 2% | 2% | 2% | 18% | 18% | 18% | 18% | 64% | 64% | 64% | 64% |
| 3% | 3% | 3% | 3% | 20% | 20% | 20% | 20% | 68% | 68% | 68% | 68% |
| 4% | 4% | 4% | 4% | 24% | 24% | 22% | 24% | 72% | 72% | 72% | 72% |
| 5% | 5% | 5% | 5% | 28% | 28% | 24% | 28% | 76% | 76% | 76% | 76% |
| 6% | 6% | 6% | 6% | 32% | 32% | 26% | 32% | 80% | 80% | 80% | 80% |
| 7% | 7% | 7% | 7% | 36% | 36% | 28% | 36% | 84% | 84% | 84% | 84% |
| 8% | 8% | 8% | 8% | 40% | 40% | 30% | 40% | 88% | 88% | 88% | 88% |
| 9% | 9% | 9% | 9% | 44% | 44% | 32% | 44% | 92% | 92% | 92% | 92% |
| 10% | 10% | 10% | 10% | 48% | 48% | 34% | 48% | 96% | 96% | 96% | 96% |
| 12% | 12% | 12% | 12% | 52% | 52% | 36% | 52% | 100% | 100% | 100% | 100% |

COLOR GRADATION PATCHES FOR SECOND GRADATION EXPRESSION METHOD

FIG.14

P

| Black | Yellow | Magenta | Cyan | Black | Yellow | Magenta | Cyan | Black | Yellow | Magenta | Cyan |
|---|---|---|---|---|---|---|---|---|---|---|---|
| 40% | 14% | 0% | 40% | 14% | 0% | 40% | 14% | 0% | 40% | 14% | 0% |
| 44% | 16% | 1% | 44% | 16% | 1% | 44% | 16% | 1% | 44% | 16% | 1% |
| 48% | 18% | 2% | 48% | 18% | 2% | 48% | 18% | 2% | 48% | 18% | 2% |
| 52% | 20% | 3% | 52% | 20% | 3% | 52% | 20% | 3% | 52% | 20% | 3% |
| 56% | 22% | 4% | 56% | 22% | 4% | 56% | 22% | 4% | 56% | 22% | 4% |
| 60% | 24% | 5% | 60% | 24% | 5% | 60% | 24% | 5% | 60% | 24% | 5% |
| 64% | 26% | 6% | 64% | 26% | 6% | 64% | 26% | 6% | 64% | 26% | 6% |
| 68% | 28% | 7% | 68% | 28% | 7% | 68% | 28% | 7% | 68% | 28% | 7% |
| 76% | 30% | 8% | 76% | 30% | 8% | 76% | 30% | 8% | 76% | 30% | 8% |
| 84% | 32% | 9% | 84% | 32% | 9% | 84% | 32% | 9% | 84% | 32% | 9% |
| 92% | 34% | 10% | 92% | 34% | 10% | 92% | 34% | 10% | 92% | 34% | 10% |
| 100% | 36% | 12% | 100% | 36% | 12% | 100% | 36% | 12% | 100% | 36% | 12% |

COLOR GRADATION PATCHES FOR FIRST GRADATION EXPRESSION METHOD

| Cyan | Magenta | Yellow | Black | Cyan | Magenta | Yellow | Black | Cyan | Magenta | Yellow | Black |
|---|---|---|---|---|---|---|---|---|---|---|---|
| 0% | 14% | 40% | 0% | 14% | 40% | 0% | 14% | 40% | 0% | 14% | 40% |
| 1% | 16% | 44% | 1% | 16% | 44% | 1% | 16% | 44% | 1% | 16% | 44% |
| 2% | 18% | 48% | 2% | 18% | 48% | 2% | 18% | 48% | 2% | 18% | 48% |
| 3% | 20% | 52% | 3% | 20% | 52% | 3% | 20% | 52% | 3% | 20% | 52% |
| 4% | 22% | 56% | 4% | 22% | 56% | 4% | 22% | 56% | 4% | 22% | 56% |
| 5% | 24% | 60% | 5% | 24% | 60% | 5% | 24% | 60% | 5% | 24% | 60% |
| 6% | 26% | 64% | 6% | 26% | 64% | 6% | 26% | 64% | 6% | 26% | 64% |
| 7% | 28% | 68% | 7% | 28% | 68% | 7% | 28% | 68% | 7% | 28% | 68% |
| 8% | 30% | 76% | 8% | 30% | 76% | 8% | 30% | 76% | 8% | 30% | 76% |
| 9% | 32% | 84% | 9% | 32% | 84% | 9% | 32% | 84% | 9% | 32% | 84% |
| 10% | 34% | 92% | 10% | 34% | 92% | 10% | 34% | 92% | 10% | 34% | 92% |
| 12% | 36% | 100% | 12% | 36% | 100% | 12% | 36% | 100% | 12% | 36% | 100% |

COLOR GRADATION PATCHES FOR SECOND GRADATION EXPRESSION METHOD

P

IMAGE FORMING APPARATUS

BACKGROUND OF THE INVENTION

1. Field of the Invention

The present invention relates to an image forming apparatus capable of optimizing gradation expression of input image data, for example.

2. Description of the Related Art

In an image forming apparatus such as a copying machine and a printer using electrophotographic technology, an electrostatic latent image is formed on a photosensitive member by uniformly charging the photosensitive member by a charging roller and exposing the photosensitive member to laser light, for example, according to an image signal based on image data. The thus-formed electrostatic latent image is developed with toner at a developing portion, and the developed toner image is transferred onto a transfer material by a transfer roller. The toner image transferred onto the transfer material is fixed on the transfer material by a fixing device, and then the transfer material is discharged from the image forming apparatus.

In such an image forming apparatus, a high quality output image is reproduced by selecting among various gradation expression methods depending on the type of the image data (text/line-work, graphic, map, developing paper, photograph, printing, etc.). To stabilize the quality of an output image, the adjustment (calibration) of image formation conditions such as density correction and gradation correction is performed according to the state of the image forming apparatus by forming a predetermined pattern on an image bearing member in advance of the image formation and reading a density of the predetermined pattern.

The adjustment is performed for the purpose of calibrating minute fluctuations that are caused during the continuous use of the image forming apparatus in reproducibility of gradation and density of the gradually output image to standard and normal levels. The fluctuations in image density and gradation reproducibility includes a fluctuation due to a change in environment and a fluctuation due to temporal changes of the photosensitive member and the toner, and it is necessary to correct these fluctuations at once to integrate the output image density and the gradation reproducibility.

In the conventional method, a test pattern (test chart), which is an index for correction, is firstly printed out on a transfer material to find gradation characteristics of an output image of the image forming apparatus itself. Subsequently, the transfer material on which the test pattern is formed is placed on a reader unit, and patterns of gradation levels are read by the reader unit. After that, level values of the read-out gradations and reference values previously stored in the image forming apparatus are compared to each other, and, in the case where there is a difference, the difference is fed back to adjust the image processing conditions such as gradation correction to an optimum state by which standard level printing is enabled.

In performing such calibration, an operator prints out the test pattern on a transfer material for each of gradation expression methods provided in the image forming apparatus. After that, the work of placing (setting) the transfer material on the reader unit for reading is performed for a number of times that is the same as the number of gradation expression methods (e.g., for a number of times that is the same as the number of transfer materials on which the test patterns are printed) to perform the adjustment for each of the gradation expression methods. Therefore, the frequent calibration work may be bothersome for the operator, and the number of transfer materials used for the calibration is increased with a required time for the adjustment being increased. In this regard, Japanese Patent Application Laid-Open No. 2003-054078 discusses a method for performing adjustment of image processing conditions such as gradation correction based on test patterns of two types of gradation expression methods that are printed on one transfer material.

With the method, it is possible to reduce transfer material consumption as well as to shorten the time required for adjustment by printing the test patterns of two types of gradation expression methods on one transfer material. However, since the test patterns of different gradation expression methods are disposed adjacent to each other in a sub-scanning direction, the test pattern to be used for the adjustment is more subject to influences to be caused when the gradation expression method is changed. The influences include a memory image at the developing portion for developing the test pattern, and a photosensitive member memory image on the photosensitive member, formed when changing the gradation expression method. Since the test pattern is used as the index for the correction, once the test pattern is influenced by the fluctuation attributable to the fluctuations in the image forming apparatus and the fluctuations attributable to the changes in photosensitive member and toner, the test pattern influences the adjustment of the image processing conditions such as gradation correction. More specifically, in the case where test patterns of a plurality of gradation expression methods are printed on one transfer material, influence of a memory image caused in formation of a test pattern using one of the gradation expression methods tends to be exerted on formation of a test pattern using another one of the gradation expression methods.

In the case where the direction of a rotation axis of the photosensitive member is set as the main scanning direction, a direction orthogonal to the main scanning direction is referred to as a sub-scanning direction, which is orthogonal to a rotation axis of the transfer roller.

An memory image that may occur at the developing portion will be briefly described below with reference to FIG. 16. For easy understanding, an assumption of forming a pattern illustrated in FIG. 16 on one recording medium P is made. The length direction of the recording medium is a rotation direction of a photosensitive member 4 and corresponds to a conveyance direction (direction of the arrow) of the recording medium, and the width direction is an axial direction of each of the photosensitive member 4 and a developing cylinder provided in a developing portion 3 and corresponds to a main scanning direction by a laser. In the example illustrated in FIG. 16, a white hollow circle pattern is formed on a solid black image (uniformly black image) on the left half part in the axial direction of the photosensitive member 4 and the developing cylinder, and a black hollow circle pattern is formed on the right half part, followed by a halftone solid image (uniform image), which is formed by changing the gradation expression method.

In the developing portion 3 using electrophotographic technology, a powdery developer called toner is housed in a toner container inside the developing portion 3, and the toner is uniformly coated on the developing cylinder, so that the toner is conveyed to a nip portion between the developing cylinder and the photosensitive member by the rotation of the developing cylinder. During the conveyance of the toner by the developing cylinder, the toner is electrically charged by friction with the developing cylinder or friction between the toner particles, and an electrostatic latent image formed on the photosensitive member is developed as a toner image.

However, a part without an image is not developed by the toner even when the toner is transferred by the developing cylinder. Therefore, when the developing cylinder is rotated once more, a difference in toner electrical charge amount can sometimes occur on the developing cylinder between a part developed by the first rotation and a part not developed. In such case, a memory image at a rotation cycle of the developing cylinder is generated as illustrated in FIG. 16. As is apparent from FIG. 16, memory images of the solid black image, the white hollow circle pattern, and the black hollow circle pattern are formed, due to influence of the images that are formed previously, on the area on which the halftone solid image is uniformly formed by changing the gradation expression method. The memory images (abnormal images) may occur not only in the second lap but also in the third lap of the rotation of the developing cylinder as illustrated in FIG. 16, and may also occur even in the fourth and fifth laps.

In the case where the abnormal image is generated on the test pattern during the calibration, since cyclical irregularity occurs on the test pattern due to the influence generated by another gradation expression method, the image adjustment can be unsuccessful.

Also, the photosensitive member memory image means a vaguely remaining image of an image formed at a previous lap of the rotation of the photosensitive member that is subjected to image exposure depending on a state of the photosensitive member. The photosensitive member memory image is substantially similar to that illustrated in FIG. 16 except that the image is generated at the photosensitive member cycle, and the formed test pattern is subject to the influence of the photosensitive member cycle, thereby making it difficult to perform the image adjustment successfully.

It is possible to reduce the number of recording mediums to be used by printing test patterns of a plurality of gradation expression methods on one recording medium. However, the influence of the memory image generated due to the formation of the test pattern of one of the gradation expression methods is exerted on the test pattern of another one of the gradation expression methods and further on the adjustment of the image processing conditions such as the gradation correction.

The above example is described as a problem on one recording medium since the influence is of the pattern formed at a leading part of one recording medium. Also, in the case where a continuous pattern is formed from a leading end to a trailing end in the conveyance direction of the first recording medium, for example, a problem of a memory image similar to that described above occurs on a pattern to be formed on a second recording medium when an interval between the recording mediums is short. In this case, it is possible to alleviate the influence by widening the sheet feed interval between the first recording medium and the second recording medium for a predetermined multiple number of a peripheral length of the developing cylinder. However, an extra recording medium output time is required for the increase in sheet feed interval.

SUMMARY OF THE INVENTION

The present invention is directed to an image forming apparatus capable of reducing influence of a memory image in a photosensitive member or a developing portion during calibration.

According to an aspect of the present invention, an image forming apparatus includes an image forming unit including a photosensitive member, an exposure portion configured to form a latent image on the photosensitive member, and a developing portion configured to develop the latent image formed by the exposure portion with toner to form the image developed by the developing portion on an image bearing member, which is conveyed in a direction orthogonal to a longitudinal direction of the photosensitive member, a control unit configured to cause the image forming unit to form an adjustment image on the image bearing member, and a detection unit configured to detect the adjustment image, wherein the control unit controls gradation for forming an image by the image forming unit based on a detection result provided by the detection unit, and wherein, when causing the image forming unit to form a first adjustment image on the image bearing member at the photosensitive member and to subsequently form a second adjustment image that is different from the first adjustment image, the control unit causes the image forming unit to form the second adjustment image at a position different from a position for forming the first adjustment image in the longitudinal direction of the photosensitive member.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

FIG. 13 is a diagram illustrating a color test pattern image formed of color gradation patch patterns.

FIG. 14 is a diagram illustrating a combination of color test pattern images in the case of continuously outputting a color test pattern image over a plurality of recording sheets.

DETAILED DESCRIPTION OF THE EMBODIMENTS

Various exemplary embodiments, features, and aspects of the invention will be described in detail below with reference to the drawings.

Figure 1:
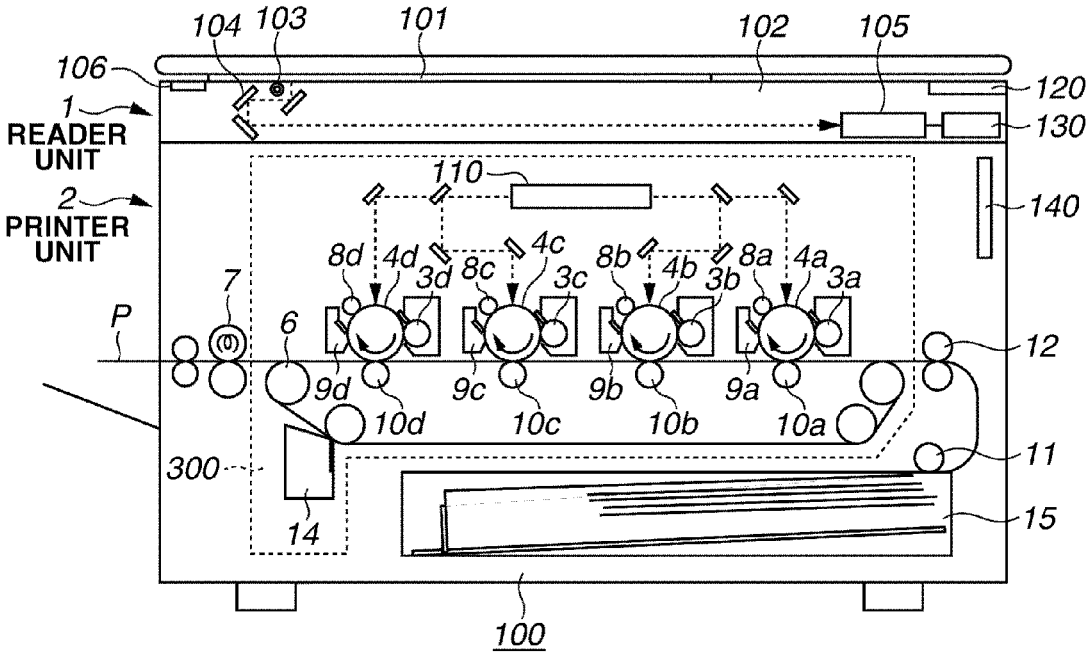
FIG. 1 is a diagram illustrating an overall structure of a color copying machine.
Figure 2:
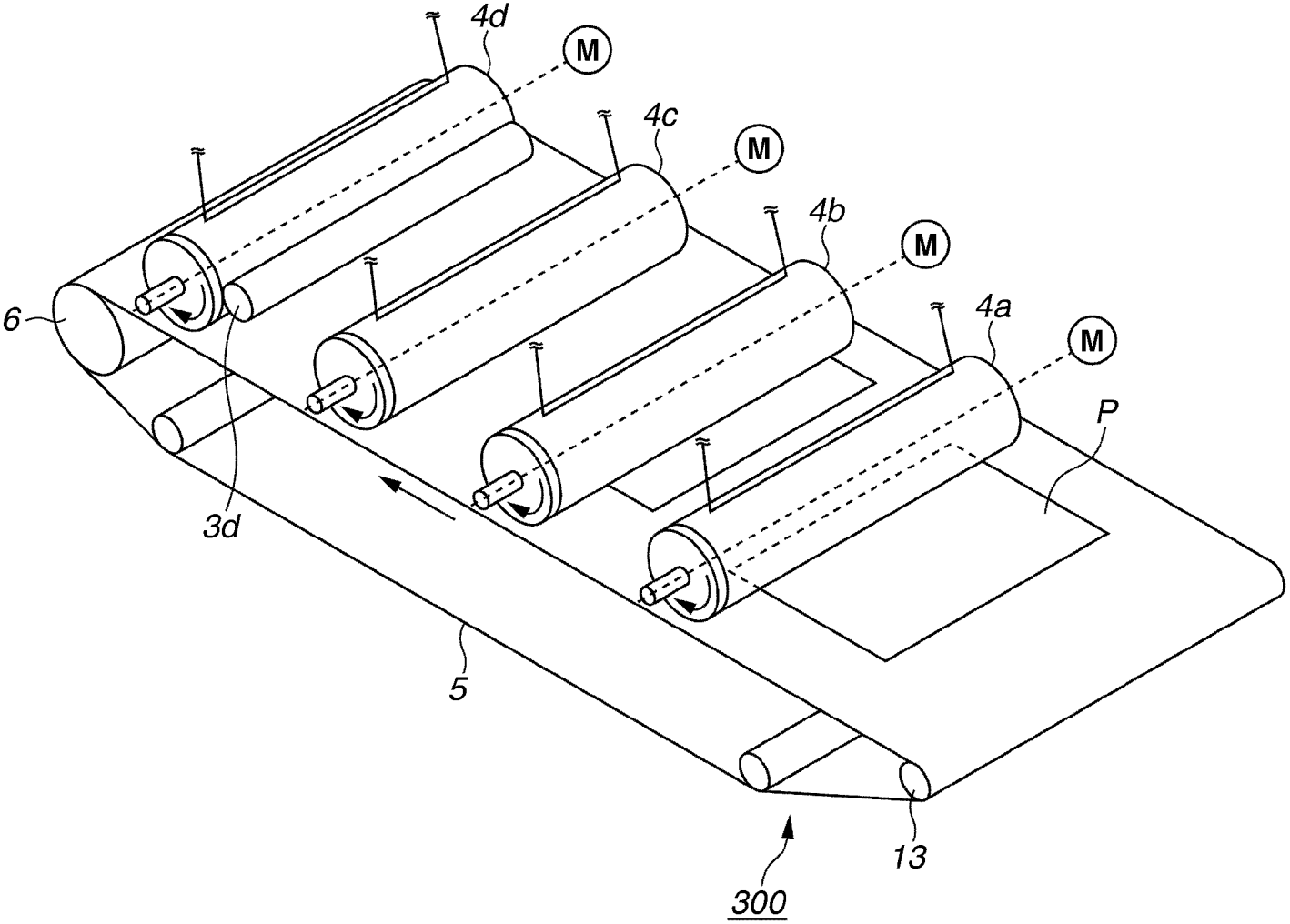
FIG. 2 is a perspective view illustrating a structure of a printer engine unit.

FIG. 1 is a sectional view illustrating a color image forming apparatus 100 according to an exemplary embodiment of the present invention. FIG. 2 is a perspective view illustrating a main portion of a printer engine unit 300. The color image forming apparatus 100 includes a reader unit 1 for reading an original image and a printer unit 2 for reproducing (recording) an image on a recording medium, which is an image bearing member, based on image data obtained by the reader unit 1.

In the reader unit 1, a document 101 placed on a document positioning plate 102 is irradiated by a light source 103. Light reflected from the document 101 is focused on a charge-coupled device (CCD) sensor 105 via an optical system 104. The CCD sensor 105 is provided with three lines of CCD line (array) sensors (not illustrated) that are disposed adjacent to one another in three lines, to which red (R), green (G), and blue (B) filters are attached. Color component signals for red, green, and blue are generated by the line sensors from the light made incident via the optical system 104.

Also, the light source 103 and the optical system 104 scan, as a document scanning unit, the document 101 while performing the above-described operation and moving at a predetermined speed to obtain the color component image signal of each of the lines of the image in the document 101 by the CCD sensor 105. A reference white board 106 is used for determining a white level of the CCD sensor 105 and performing shading correction in a thrust (array) direction of the CCD sensor 105 and is disposed opposite the optical system 104. The shading correction is performed immediately before the start of reading of the document 101 when the optical system 104 passes below the reference white board 106. An image signal output from the CCD sensor 105 is subjected to predetermined image processing by an image processing unit 130 and then input to a printer control unit 140 of the printer unit 2.

An operation unit 120 is provided near the document positioning plate 102, on which a switch for performing various mode settings related to copy sequence of the color image forming apparatus 100, a display for displaying, and a display unit are disposed. Also, an instruction for staring operation of calibration can be issued via the operation unit 120.

In the printer unit 2, the printer control unit 140, which is a controller unit, includes a controller board provided with a central processing unit (CPU), a random access memory (RAM), and a read only memory (ROM). The color image forming apparatus 100 controls operations of a sheet feeding unit, an image forming unit, a transferring/conveying unit, a fixing unit, and an operation unit in an integrated manner based on a control program stored in the ROM.

The printer engine unit 300 has the structure described below. Photosensitive members 4*a*, 4*b*, 4*c*, and 4*d* each are supported by a shaft at the center and rotatably driven by a driving motor (M in FIG. 2) in the direction of the arrow. The four photosensitive members 4*a*, 4*b*, 4*c*, and 4*d* are photosensitive drums for yellow, magenta, cyan, and black, respectively. The photosensitive members 4*a*, 4*b*, 4*c*, and 4*d* are referred to as the first, second, third, and fourth photosensitive members, respectively. Roller charging units 8*a* to 8*d*, a scanner unit 110, developing portions 3*a* to 3*d*, cleaning devices 9*a* to 9*d* are disposed as opposed to an outer periphery of the photosensitive members 4*a* to 4*d* and in a rotation direction of the photosensitive members 4*a* to 4*d*. In the roller charging units 8*a* to 8*d*, electrical charges having a uniform charge amount are applied to surfaces of the photosensitive members 4*a* to 4*d*. Then, electrostatic latent images are formed on the photosensitive members by exposing, by the scanner unit 110, the photosensitive members 4*a* to 4*d* to light such as a laser beam that is modified according to the recording image signal. Further, the electrostatic latent images are developed by the developing portions 3*a* to 3*d*, which contain developers (hereinafter, referred to as "toners") of four colors of yellow, magenta, cyan, and black, respectively.

Each of the developing portions 3*a* to 3*d* is used for uniformly coating the toner on the developing cylinder and conveying the toner to the nip portion of the photosensitive member by the rotation of the developing cylinder. During the conveyance by the developing cylinder, the toner is electrically charged by the friction with the developing cylinder or the friction of toner particles and then developed as a toner image on the photosensitive member on which the electrostatic latent image is formed.

The thus-developed visible images are sequentially transferred onto a recording medium (image bearing member) conveyed by the transfer belt 5. After that, the residual toners on the photosensitive members 4*a* to 4*d* are collected by cleaning devices 9*a* to 9*d*. By the above-described process, the image formations by the toners are sequentially performed.

The sheet feeding unit includes a part for housing the recording medium P, a portion for conveying the recording medium P, a sensor for detecting passing of the recording medium P, a sensor for detecting absence/presence of the recording medium P, and a guide (not illustrated) for conveying the recording medium P along the conveyance path. The recording medium P is housed in a cassette 15. A pickup roller 11 feeds the recording materials one after another to convey the recording materials to the registration roller 12.

The transfer/feeding unit will be described below in detail. The transfer belt 5 has an electroconductive elastic layer formed from a urethane rubber, silicon rubber, or a polychloroprene (CR) rubber on a base layer, and a surface layer made from a fluorine resin, or a fluorine-contained rubber (FKM) is formed on a surface of the transfer belt 5. The transfer belt 5 is supported by a driving roller 6 for transmitting the driving to the transfer belt 5, a tension roller for imparting an appropriate tensile force to the transfer belt 5 by way of biasing by a spring (not illustrated), and a driven roller 13.

The driving roller 6 is rotatably driven by a stepping motor (not illustrated). Transfer rollers 10*a* to 10*d* are disposed at the rear of the transfer belt 5 that is at a position opposed to the photosensitive members 4*a* to 4*d* across the transfer belt 5. Transfer rollers 10*a* to 10*b* apply a high voltage to transfer the toner images to the recording material conveyed by the transfer belt 5. Also, the transfer belt 5 is provided with a belt cleaning device 14 for cleaning an image formation surface of the transfer belt 5.

The fixing unit 7 is formed of a fixing roller provide with an internal heat source such as a halogen heater and a pressing roller (the roller is provided with a heat source in some cases) which is pressed by the fixing roller.

When a print start signal is sent from a personal computer connected to the color image formation apparatus 100 or the operation unit 120, the recording medium P housed in the cassette 15 is conveyed by the pickup roller 11 one after another from the top to the registration roller 12. Here, the registration roller 12 is stopped, and the tip of the recording medium P contacts the nip portion.

When an image formation operation start signal is sent from the printer control unit 140, electrostatic latent images are formed on the photosensitive members for the colors by the exposure units. The yellow electrostatic latent image is formed on the first photosensitive member; the magenta electrostatic latent image is formed on the second photosensitive member; the cyan electrostatic latent image is formed on the third photosensitive member; and the black electrostatic latent image is formed on the fourth photosensitive member. The toner image formed on the photosensitive member 4*a* (first photosensitive member), which is most upstream in the rotation direction of the transfer belts 5, is transferred onto the recording medium P, which is conveyed by the transfer belt 5, by the transfer roller 10*a*, to which a high voltage is applied. The recording medium P on which the toner image is transferred is conveyed to a transfer area of the subsequent photosensitive member.

At each of the image forming units, the image formation is performed with a delay for a time period during which the toner image is conveyed among the image forming units, so that the subsequent toner image is transferred onto the recording medium P with the leading end of the image aligned on the previous image. Such process is repeated in the subsequent steps, so that the four color toner images are transferred onto the recording medium P.

After that, the recording medium P is guided to the fixing roller nip portion of the fixing unit 7. The toner images are fixed on the surface of the recording medium P with heat of the fixing unit 7 and a pressure of the nip. After that, the recording medium P is discharged from the color image formation apparatus 100, so that the series of image formation operations are terminated. In the present exemplary embodiment, the image forming units are disposed in the order of yellow, magenta, cyan, and black from the upstream side, but the order is determined depending on performance of the apparatus and is not limited to the example.

Figure 3:
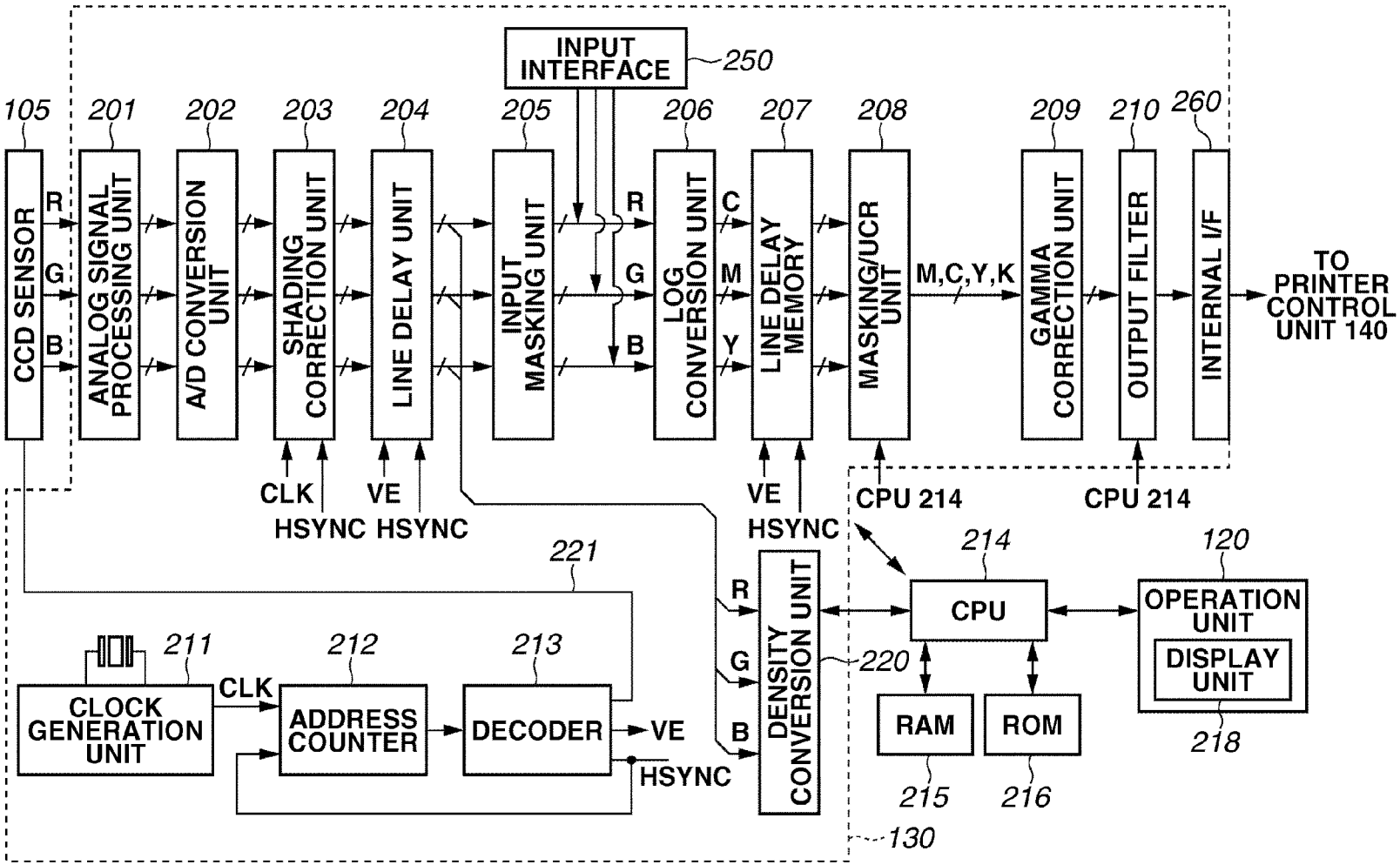
FIG. 3 is a block diagram illustrating an image processing unit.

FIG. 3 is a block diagram illustrating an image processing unit 130 according to the present exemplary embodiment. A ROM 216 in which a control program is written, and a RAM 215 storing data for performing processing are connected to a CPU 214 via an address bus and a data bus. Also, the CPU 214 is provided with an input interface 250 for performing communication with external devices. Also, an internal interface (I/F) unit 260 for performing communication with the printer control unit 140 is connected to the CPU 214. Control on the reader unit 1 including the following structures is performed according to the program that is previously stored in the ROM 216. The RAM 215 is used by the CPU 214 as a work area, and a control program, and image processing parameters are also stored in the ROM 216. The operation unit 120, which has a keyboard (not illustrated), a touch panel (not illustrated), a display unit 218 such as a liquid crystal display device, transmits an instruction from an operator to the CPU 214 and performs display of an operation mode and a state of the color copying machine under the control of the CPU 214. The operation unit 120 is capable of instructing the start of calibration.

An address counter 212 counts a clock CLK, which is generated by a clock generation unit 211 at a unit of a pixel, to output a main scanning address signal representing a pixel address for one line. A decoder 213 decodes the main scanning address signal output from the address counter 212. Simultaneously, the decoder 213 outputs a signal 221 such as a shift pulse for driving the CCD sensor by a unit of a line and a reset pulse, a signal VE representing an effective interval in the signals for one line output from the CCD sensor 105, and a line synchronization signal HSYNC. The address counter 212 is cleared by the line synchronization signal HSYNC output from the decoder 213 to start counting of a main scanning address of the next line.

The RGB analog image signals output from the CCD sensor 105 are input to the analog signal processing unit 201 to adjust again and offset. After that, conversion into RGB digital image data of 8 bits, for example, is performed on each of the color component by an analog/digital (A/D) conversion unit 202. A line synchronization signal HSYNC and a clock CLK on one-pixel-unit are added, at a shading correction unit 203, to the RGB digital image data output from the A/D conversion unit 202. Known shading correction is performed on the RGB digital image data for each of the colors using a signal obtained by reading a reference white board 106.

A line delay unit 204 corrects a spatial shift contained in image data output from the shading correction unit 203. The spatial shift is caused since the line sensors of RGB of the CCD sensor 105 are disposed with a predetermined distance being defined between the adjacent line sensors in the sub-scanning direction. More specifically, line delaying is performed in the sub-scanning direction of the image data of each of color components R and G based on the B color component signal to synchronize phases of the three color component signals. A signal VE representing an effective interval in signals for one line and a line synchronization signal HSYNC are added to the RGB digital image data.

An input masking unit 205 converts a color space of image data output from the line delay unit 204 into an National Television System Committee (NTSC) normal color space by a matrix operation of the following expression (1). More specifically, each of the color spaces of the color component signals output from the CCD sensor 105 is determined depending on spectroscopic characteristics of the filter of each of the color components, and the color space is converted into an NTSC normal color space.

$$R0=a11a12a13Ri$$

$$G0=a21a22a23Gi$$

$$B0=a31a32a33Bi \quad (1)$$

where R0, G0, and B0 are output image signals, and Ri, Gi, and Bi are input image signals.

In the case of using the color copying machine as a printer, image data is input to the input interface 250 from an external device such as a computer (not illustrated).

A LOG conversion unit 206 is formed of a look-up table formed of a ROM, for example, and converts RGB luminance data output from the input masking unit 205 into density data of C (Cyan), M (Magenta), and Y (Yellow). A line delay memory 207 delays the image signals output from the LOG conversion unit 206 for a time period (line delay) during which a black character determining unit (not illustrated) generates control signals such as UCR, FILTER, and SEN from the outputs from the input masking unit 205.

The control signal UCR is used for controlling a masking/UCR unit 208. The control signal FILTER is used by an output filter 210 for performing edge enhancement. The control signal SEN is used for increasing resolution in the case where the black character determining unit (not illustrated) determines a black character.

The masking/UCR unit 208 extracts a black component signal K from the image data output from the line delay memory 207. Further, the masking/UCR unit 208 performs a matrix operation for correcting color turbidity of the toners used as the developers of the printer unit 2 on YMCK image data to output color component image data of 8 bits in a frame sequential manner of M, C, Y, and K, for example. A matrix coefficient used for the matrix operation is set by the CPU 214.

A gamma correction unit 209 performs density correction on the MCYK image data output from the masking/UCR unit 208 in a frame sequential manner to adjust the image data to those having gradation characteristics optimized for the printer unit 2.

The output filter (spatial filter processing unit) 210 performs edge enhancement or smoothing processing on the image data output from the gamma correction unit 209 according to the control signals from the CPU 214.

Also, a density conversion unit 220 is used for converting the RGB image data output from the line delay unit 204 into data of optical density.

The MCYK frame sequential color component image data processed as described above is output to the printer control unit 140. Dither pattern image data expressed by a pseudo gradation expression (gradation expression method) based on the type of the image data is formed by the printer unit 2, and density recording on a recording medium is performed based on a pulse signal output based on the image data.

Figure 4:
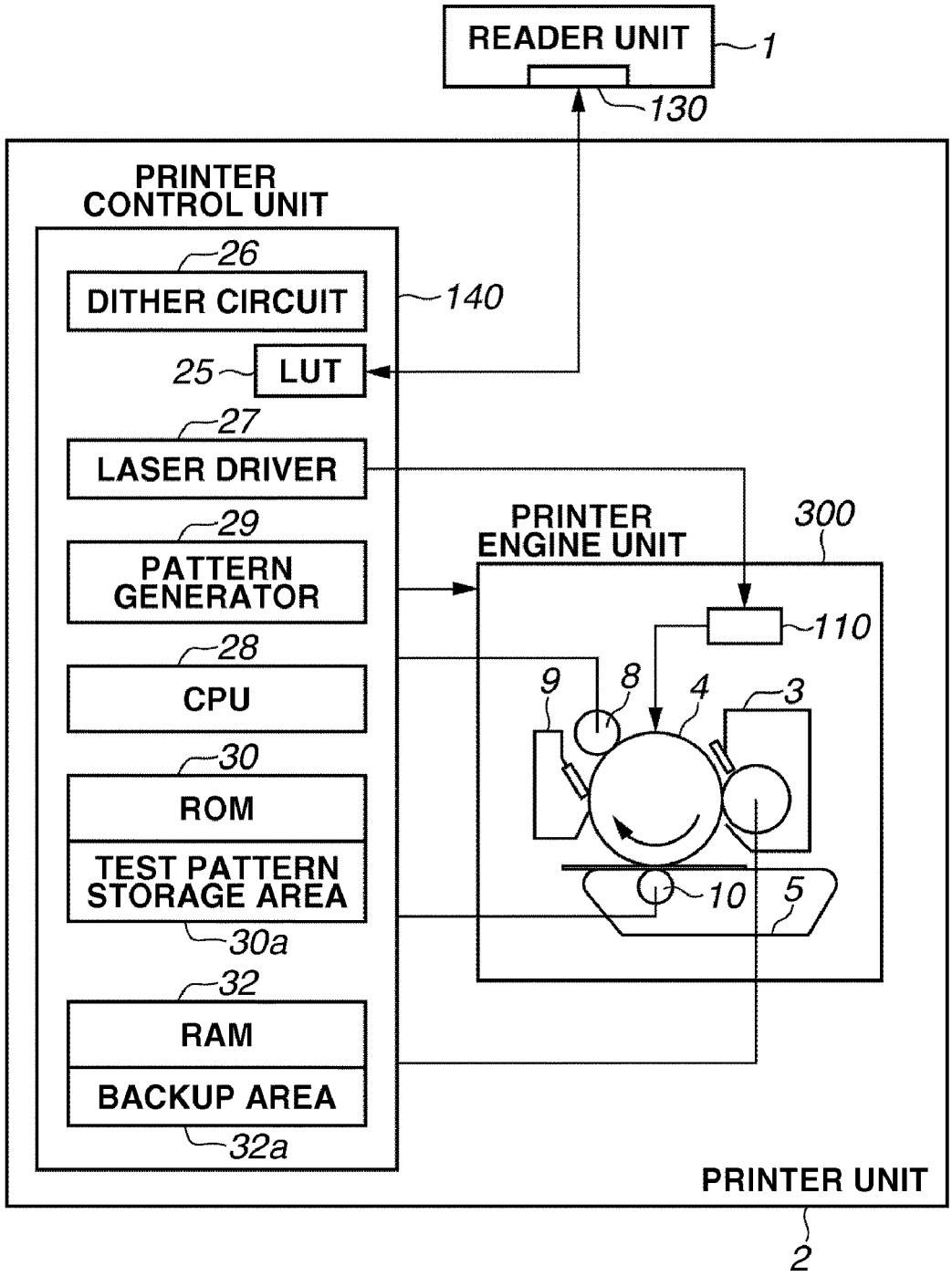
FIG. 4 is a block diagram illustrating a printer control unit.

FIG. 4 is a block diagram illustrating the printer control unit 140 according to the present exemplary embodiment. In the printer engine unit 300 in FIG. 4, only one of the image forming units for four colors is illustrated. Configurations of the image forming units are basically similar although the operation timing is varied in the rest of three image forming units.

The image data input from the image processing unit 130 of the reader unit 1 to the printer control unit 140 is converted by a dither circuit 26 into a pulse signal corresponding to the image data. The pulse signal output from the dither circuit 26 is input to a laser driver 27 to drive a laser light source of a scanner unit 110 (exposure unit). The laser light output from the laser light source based on the pulse signal from the dither circuit 26 becomes scanning light when reflected by a polygonal mirror (not illustrated) rotating at a high speed. A path of the scanning light is changed by the mirror to ultimately scan the photosensitive member 4 in the main scanning direction, which is the axial direction of the photosensitive member 4. Here, since the photosensitive member 4 is being rotated in a direction indicated by the arrow in FIG. 4 at a predetermined speed and is uniformly charged by the roller charging unit 8, an electrostatic image is formed on the photosensitive member 4 by the scanning of the photosensitive member 4 by the laser light.

In each of the image forming units for the colors of YMCK, the latent image is formed on the photosensitive member 4, and a toner image is developed by the developing portion 3. In the present exemplary embodiment, the two-component system is employed as the developing method, and the image forming units are disposed in the order of yellow, magenta, cyan, and black from the upstream side in a direction along which the recording medium P is conveyed by the transfer belt 5. Each of the image forming units forms an electrostatic latent image on the photosensitive member 4 according to the color to be reproduced under the control of the printer control unit 140, and the electrostatic latent image is developed into a toner image by the developing portion 3.

The recording medium P supplied from a recording sheet cassette is conveyed and electrostatically attached to the transfer belt 5. On the recording medium P conveyed by the transfer belt 5, the toner image on the photosensitive member 4 is transferred at the nip portion between the photosensitive member 4 for each of the colors and the transfer roller 10. Accordingly, by a total of four transfers, a toner image on which the four color toner images are overlapped is formed on the recording medium P.

The recording medium P, on which the transfers of yellow, magenta, cyan, and black are performed in this order, is detached from the transfer belt 5, and then the toner image is fixed on the recording medium P by the fixing unit 7, so that full color image printing is accomplished.

In the printer control unit 140, a CPU 28 controls the printer unit 2 including the printer engine unit 300 and the following structures according to the program previously stored in a ROM 30. Further, the CPU 28 communicates with the CPU 214 of the reader unit 1 to perform operation such as copying in cooperation with the CPU 214. A RAM 32 is used as a work area by the CPU 28, and the ROM 30 stores control parameters in addition to the control program. The RAM 32 includes a test pattern storage area 30*a* (details of which are described below) in which data corresponding to a predetermined test pattern is previously stored. Further, the RAM 32 includes a backup area 32*a*, which is backed up by a battery, to retain image formation parameters.

A look-up table (LUT) 25 is used for conforming the density of a document image to the density of an output image. For example, the look-up table 25 is formed of a RAM, and contents of the data of the table are set by the CPU 28 in a calibration mode that is started by an instruction from an operator via the operation unit 120 illustrated in FIG. 3. A pattern generator 29 outputs image data for printing out a test print to the dither circuit 26 based on data corresponding to the predetermined test pattern stored in the test pattern storage area 30*a* in the calibration mode.

Figure 5:
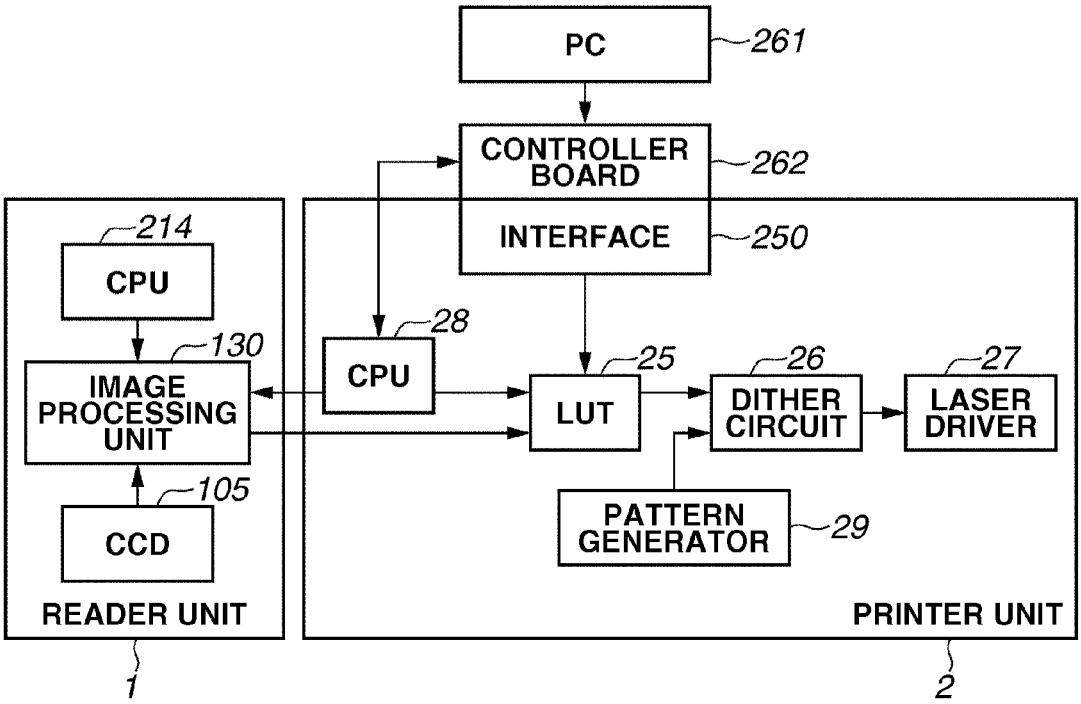
FIG. 5 is a block diagram illustrating gradation correction by a look-up table (LUT).

FIG. 5 is a block diagram illustrating gradation correction by the LUT 25 according to the first exemplary embodiment of the present invention.

The document luminance data output from the CCD sensor 105 is sequentially converted into density data by the image processing unit 130 as described above. The density data is image data that has been corrected based on gamma characteristics of the printer unit 2 having the initial settings of factory default settings. The image data output from the image processing unit 130 is input to the LUT 25. The LUT 25 converts the density characteristics of the image data input from the image processing unit 130 in such a manner that the density of the document and the density of the output image are identical to each other. The image data output from the LUT 25 is input to the dither circuit 26.

Referring to FIG. 5, the printer unit 2 has a signal line for inputting the image data read out by the reader unit 1 in the case where the printer unit 2 is used as a copying machine. The printer unit 2 as a printer may have two types of signal lines for image data including a signal line for inputting image data from an external device (PC 261). In the case where the printer unit 2 is used as a copying machine, the image data read out by the reader unit 1 is sent from the image processing unit 130 to the LUT 25 inside the printer unit 2. In the case of sending the image data from the reader unit 1 to the LUT 25, the CPU 214 of the reader unit 1 sends to the CPU 28 a signal for requesting start-up of an image formation sequence of the printer unit 2 prior to sending the image data.

In the case where the printer unit 2 is executing another job when receiving the start-up request signal of the image formation sequence from the reader unit 1, it is possible to reject the request. Therefore, in the case where another job is being executed, the CPU 214 of the reader unit 1 waits until an allowance signal is sent from the CPU 28. The image data that has been subjected to the gradation conversion by the LUT 25 is output as a pulse signal corresponding to the image by the dither circuit 26 to be sent to the laser driver 27, so that an electrostatic latent image is formed on the photosensitive member 4.

Figure 6:
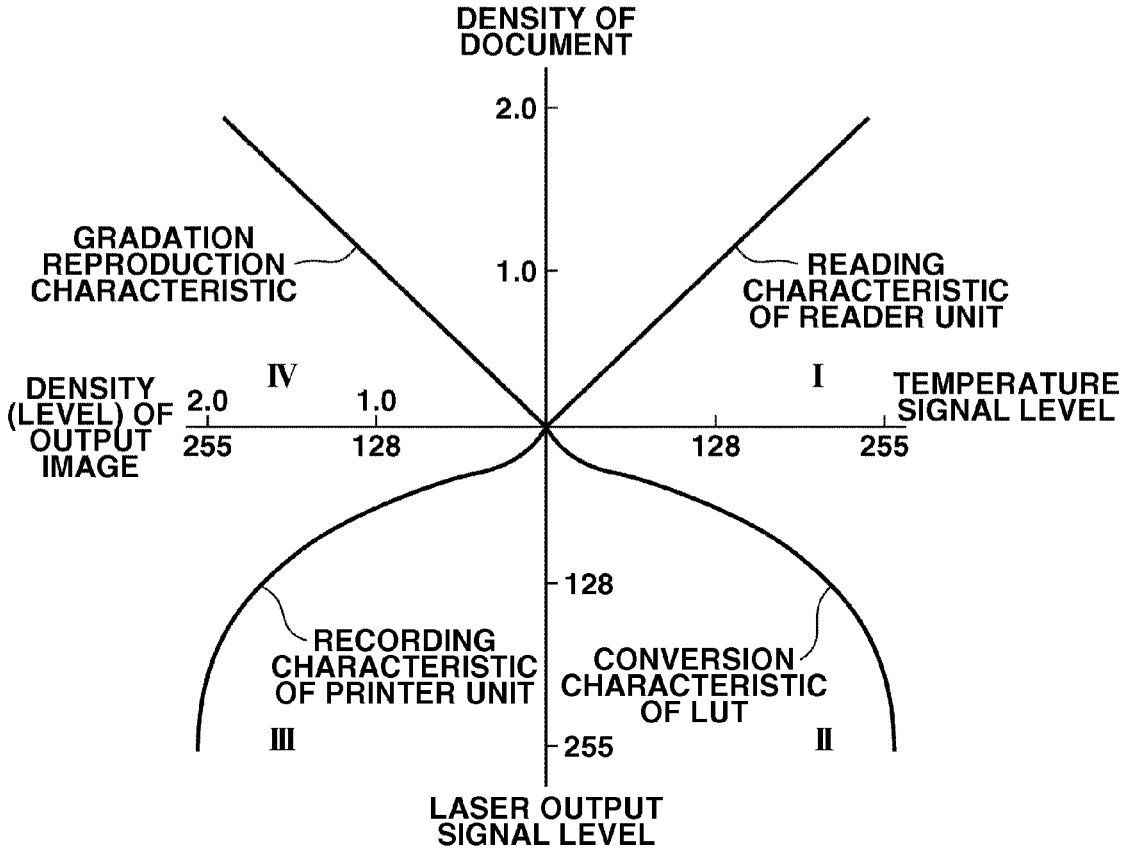
FIG. 6 is a diagram illustrating characteristics of steps for reproducing an original image.

FIG. 6 is a diagram illustrating characteristics of steps for reproducing a document image by the color image forming apparatus 100 according to the first exemplary embodiment of the present invention.

In FIG. 6, the first quadrant indicates reading characteristics of the reader unit 1, which converts the density of a document image into a density signal. The second quadrant indicates conversion characteristics of the LUT 25, which converts the density characteristics of the density signal from the reader unit 1. The third quadrant indicates recording characteristics of the printer unit 2, which converts the laser output signal into output density. The fourth quadrant indicates a relationship between the document density of an original image and the density of an output image by the printer unit 2 as well as gradation reproduction characteristics of the color copying machine. The number of gradations is 256 due to the 8-bit digital processing. The document density and the density of an output image can be measured by a commercially available density meter.

In the present exemplary embodiment, to make the gradation reproduction characteristics shown in the fourth quadrant into substantially linear characteristics, a non-linear part of the recording characteristics of the printer unit 2 shown in the third quadrant is corrected by the conversion characteristics of the LUT 25 in the second quadrant. The conversion characteristics of the LUT 25 are set by an operation result.

Gradation correction control performed by the color image forming apparatus will be described below. The gradation correction control is performed in a calibration mode selected by the operator via the operation unit 120.

Figure 7A:
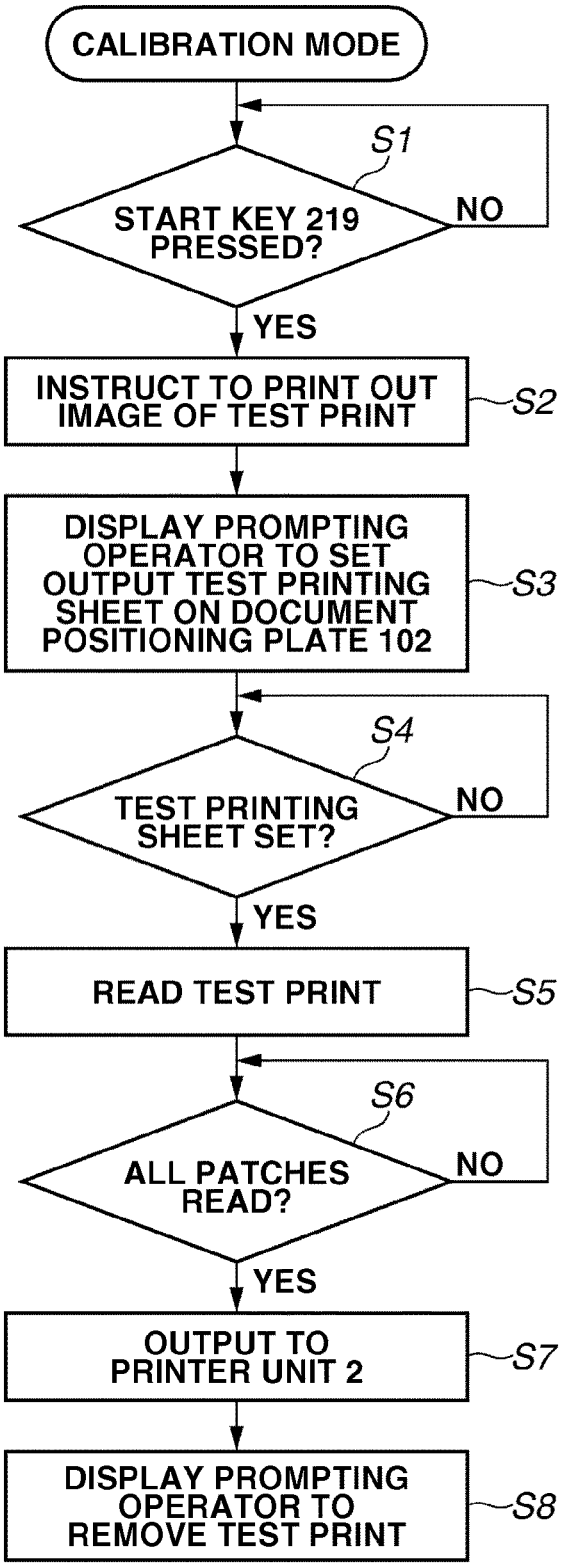
FIGS. 7A and 7B are flowcharts illustrating gradation correction processing.
Figure 7B:
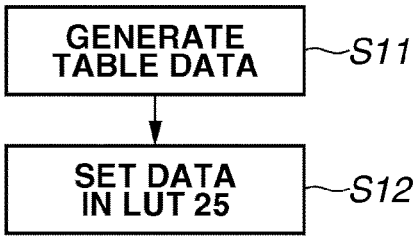
Figure 8:
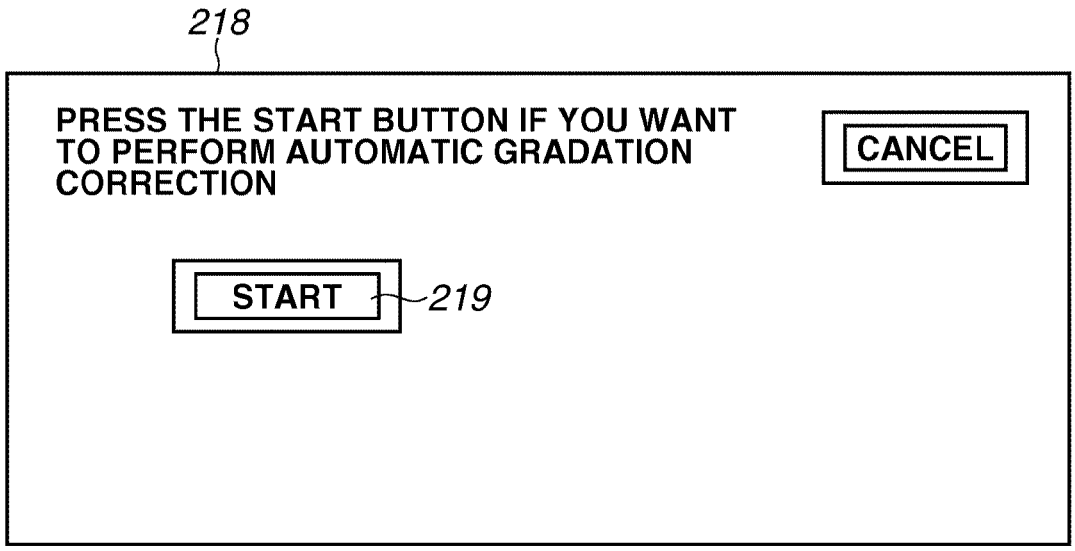
FIG. 8 is a diagram illustrating an example of a display screen of an operation unit.

FIGS. 7A and 7B are flowcharts illustrating gradation correction processing according to the first exemplary embodiment of the present invention. The processing is started when the operator presses the start key 219 (FIG. 8) for the automatic gradation correction (calibration) mode displayed on the display unit 218 of the operation unit 120. The CPU 214 of the reader unit 1 and the CPU 28 of the printer unit 2 perform the gradation control in cooperation. FIG. 7A illustrates a flowchart by the CPU 214 of the reader unit 1, and FIG. 7B illustrates a flowchart by the CPU 28 of the printer unit 2.

Figure 9:
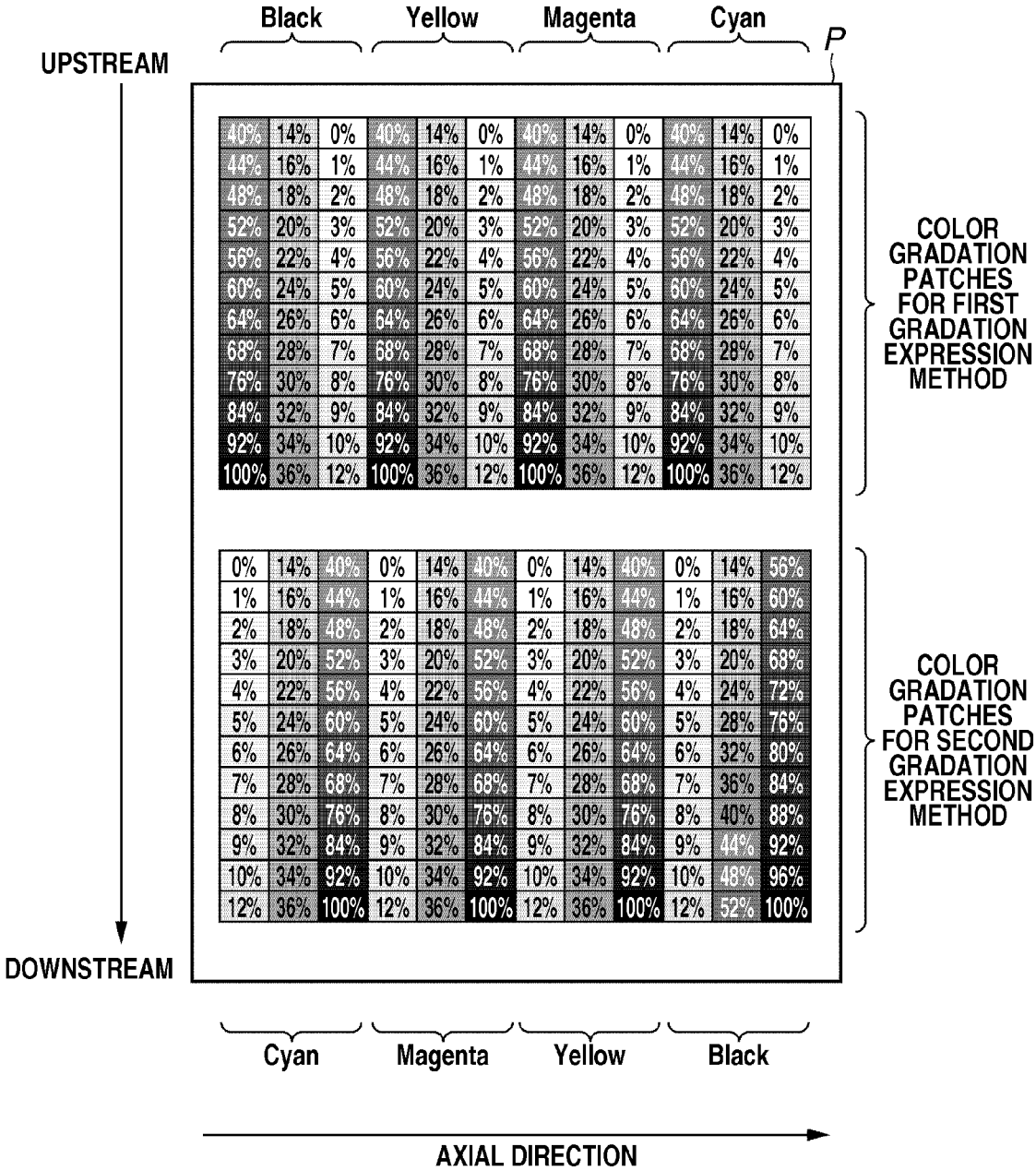
FIG. 9 is a diagram illustrating a test pattern image formed of color gradation patch patterns.

In step S1 the CPU 214 of the reader unit 1 determines whether the start key 219 is pressed by an operator. When it is determined that the start key 219 is pressed (YES in step S1), then in step S2, the CPU 214 starts up the pattern generator 29. Based on data corresponding to a predetermined test pattern stored in the test pattern storage area 30*a*, the CPU 214 generates the test pattern (adjustment image) by using the pattern generator 29. The CPU 214 gives an instruction to the CPU 28 for printing out an image of the test print as illustrated in FIG. 9 from the printer unit 2. Here, the LUT 25 is not used for outputting the test print. In step S3, the CPU 214 displays on the display unit 218 a display for prompting the operator to place the output test print on the document positioning plate 102. In this case, the CPU 214 displays a button to be pressed by the operator when the test print is placed on the document positioning plate 102. In step S4, the CPU 214 determines whether the button is pressed by the operator, i.e., whether the document is set on the document positioning plate 102. When the document is set on the document positioning plate 102 (YES in step S4), then in step S5, the CPU 214 reads the test print by using the CCD sensor 105.

FIG. 9 is a diagram illustrating an example of a test print (image bearing member on which a test pattern (adjustment image) is recorded) according to the first exemplary embodiment. Patches of each of the colors (yellow, magenta, cyan, and black) have gradations of three columns×12 rows (total 36 gradations), and the test print is formed of patch groups of the four color components of MCYK (total 144 patches). Here, the test print is formed of patch groups (total 288 patches) of two different gradation expression methods and has a first adjustment image and a second adjustment image for each of the four colors of MCYK.

The patch groups of the two gradation expression methods (dither screens) of the test print include a patch group (first adjustment image) formed of a pattern of a high resolution dither screen, which is the first gradation expression method, and a patch group (second adjustment image) formed of a pattern of a low resolution dither screen, which is the second gradation expression method.

Further, the arrangement of density gradations in each of the columns in each of the patch groups is such that the density is increased from the upper end to the lower end of the recording medium P. Here, the recording medium P is conveyed in a direction from the upper end side to the lower end side. Also, the second, low resolution dither pattern is disposed such that a density arrangement in one color is asymmetrical to the color arrangement of the identical color of the first, high resolution dither pattern.

Patch position information of each of the patches of each of the patch groups is numerically managed by the CPU 214 in the case of exposing an image of the test pattern. In step S5, the CPU 214 reads the test print and calculates an arrangement of the test pattern on the test print based on the column arrangement and the arrangement of gradation density of the black patches recorded on the test print for performing fine adjustment. The CPU 214 detects light amount information of the recording sheet corresponding to the ultimately determined pattern position data, i.e., light amount information (R, G, and B values) of the test pattern recorded on the test print.

To accurately perform the fine adjustment, the position of an edge portion of one of the patch groups is accurately detected by disposing the high density column of black at the end part of the patch group in a direction orthogonal to the conveyance direction of the recording medium P.

Here, if the test print illustrated in FIG. 9 is placed upside down on the document positioning plate 102, the highest density columns of black are allocated on an identical position. However, since the gradation density arrangement is reversed, it is possible for the CPU 214 to determine that the test print is placed in a reverse direction and to automatically perform the rearrangement of the light amount information of the test pattern, thereby avoiding troubling the user.

Here, the CPU 214 performs control in such a manner that the image signal is sent from the line delay unit 204 to the density conversion unit 220. The CPU 214 previously sets a conversion expression (table equivalent to the conversion expression) shown in expression (2) in the density conversion unit 220, so that the read-out RGB values are converted into optical density. The density conversion unit 220 adjusts the conversion results with correction coefficients km, kc, ky, and kk to obtain identical values with the commercially available density meter. The base of the logarithm is 10.

$$M=-km\times\log(G/255)$$

$$C=-kc\times\log(R/255)$$

$$Y=-ky\times\log(B/255)$$

$$K=-kk\times\log(G/255) \quad (2)$$

A reading point of the test pattern is set to a substantially central area of each of the patches, and the CPU 214 calculates an average value of the read-out values. The CPU 214 converts the average read-out values (RGB signals) into YMCK density values by the conversion expression (2) into the optical density. In step S6, the CPU 214 performs the processing on all of the patches in the test pattern. In step S7, the CPU 214 outputs the processed values to the printer unit 2.

The CPU 28 of the printer unit 2 obtains gradation characteristic information by the expression (2). More specifically, the dither circuit 26 obtains the gradation characteristic information of the laser output level that is set in the laser driver 27 based on the actual density data (detection result) of the test print obtained by the reader unit 1 and the output from the pattern generator 29.

Figure 10:
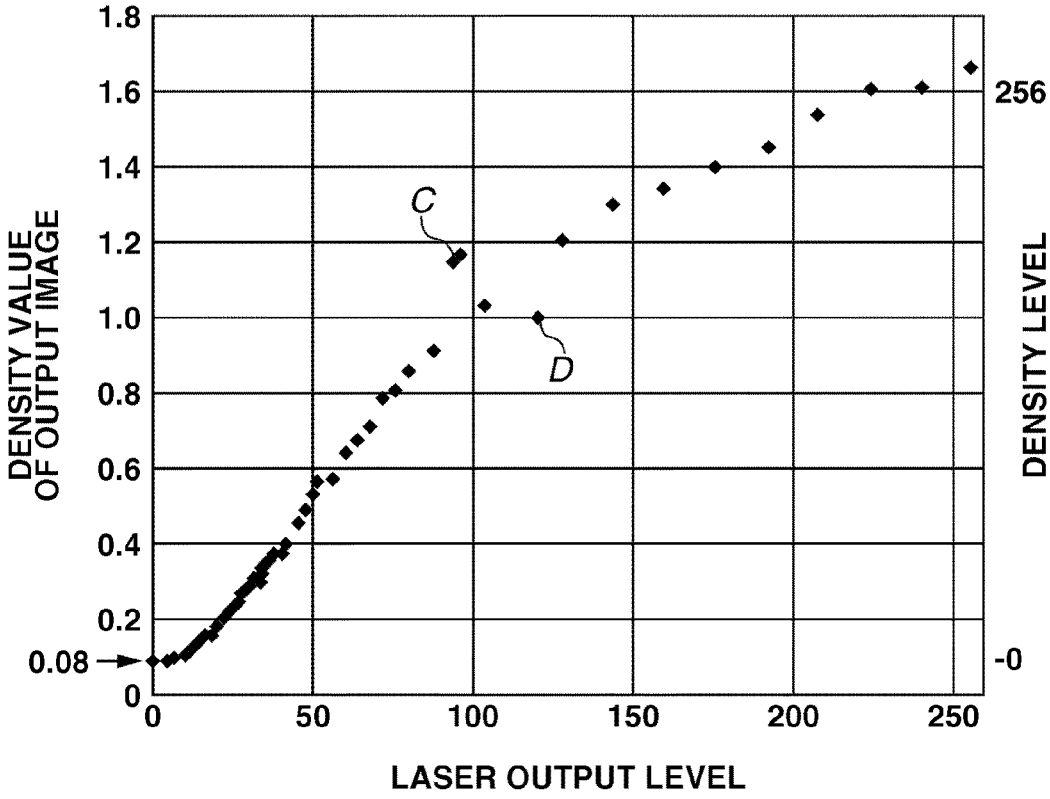
FIG. 10 is a diagram illustrating an example of a relationship between a laser output level used when a test print is output and a density value obtained by reading the patches of the output test print.

FIG. 10 is a diagram illustrating an example of a relationship between a laser output level obtained when a test print is output and a density value obtained by reading the patches of the output test print according to the first exemplary embodiment of the present invention. The horizontal axis indicates the laser output level of the laser driver 27. The left vertical axis is a density value obtained by reading an output image. The right vertical axis is a density level of the output image, wherein a density level when a base density value of a recording medium is 0.08 is set to "0", and a density value 1.60 is normalized to a density level "255" as the highest density that can be output from the color copying machine, for example.

Referring to FIG. 10, in the case where the density value of the output image is particularly high as indicated by the point C or low as indicated by the point D, the case wherein there is a contaminant or scratch on a document positioning glass positioned between the optical system 104 and the reference white board 106 or the case wherein there is a defect in test print is assumed. In such case, the CPU 28 performs correction by limiting an inclination of a characteristic curvature so that continuity of adjacent data sequences is stored. In the limitation, the inclination is fixed to 3 when the actual inclination is 3 or more, and a negative inclination is corrected to a value of a density value of the previous one, for example.

In step S11, the CPU 28 of the printer unit 2 generates data for a table to be set in the LUT 25 based on the gradation characteristic information (characteristic curvature) illustrated in FIG. 10 obtained in step S5. The table is set in the LUT 25 by changing "the density level" of the right vertical axis to the input side from the image processing unit (not illustrated) and replacing "the laser output level" of the horizontal axis with the output side to the dither circuit 26 in the gradation characteristic curvature illustrated in FIG. 10. Such processing means that the non-linear recording characteristic part of the printer unit 2 shown in the third quadrant of FIG. 6 is corrected by the conversion characteristics of the LUT 25 in the second quadrant as described in the foregoing.

A density level that does not correspond to the patches is calculated by an ordinary interpolation operation and smoothing processing to be set as data of the table. Here, a restriction condition of keeping an output level of "0" for an input level of "0" is set.

In step S12, the CPU 28 sets the data of the table generated in step S11 in the LUT 25.

In step S8, the CPU 214 of the reader unit 1 causes the display unit 218 to display removal of the test print for which the test pattern image reading is accomplished in step S12, so that the operator removes the test print.

By the above-described processing, the gradation correction processing in the calibration mode is terminated, thereby accomplishing gradation correction excellent in gradation reproducibility.

A part of the above-given description will hereinafter be described in detail. FIG. 9 is a diagram illustrating an example of the test print (recording sheet on which the test pattern is recorded) according to the first exemplary embodiment. The test pattern includes patches for gradations of 3 columns×12 rows (total 36 gradations) for each of the colors (yellow, magenta, cyan, and black), i.e., patch groups for the four color components of YMCK (total 144 patches). The test pattern is formed of patch groups for two different gradation expression methods (dither screens) (total 288 patches). The color patches (for yellow, magenta, cyan, and black) are formed by photosensitive members that are provided for respective colors.

The patch groups for the two gradation expression methods (dither screens) include a patch group formed of a pattern of a high resolution dither screen, which is the first gradation expression method, and a patch group formed of a pattern of a low resolution dither screen, which is the second gradation expression method. The patch group (first adjustment image) formed of the pattern of the high resolution dither screen, which is the first gradation expression method, and the patch group (second adjustment image) formed of the pattern of the low resolution dither screen, which is the second gradation expression method, are formed for each of the colors.

In the color copying machine in the present exemplary embodiment, the patch group formed of the pattern of the high resolution dither screen, which is the first gradation expression method, and the patch group formed of the pattern of the low resolution dither screen, which is the second gradation expression method, are positioned as described below. The pattern of the first gradation expression method and the pattern of the second gradation expression method to be formed by the same photosensitive member are not allocated at an identical position in the longitudinal direction of the photosensitive member or the developing sleeve (axial direction in FIG. 9) at the upstream side and the downstream side in the conveyance direction of the recording medium P. More specifically, the patch groups of the identical color formed according to the different gradation expression methods (first adjustment image and second adjustment image) are not formed by using the identical position in the longitudinal direction of the photosensitive member or the developing sleeve (axial direction in FIG. 9). Further, a density gradation arrangement in one column of each of the patch groups is so arranged that the density is increased from the upstream side to the downstream side in the conveyance direction of the recording medium P. Also, the second, low resolution dither pattern is arranged in a symmetrical fashion with the first, high resolution dither pattern in terms of a color order and a color density order.

A black patch group (first adjustment image) (black patch group on the upper left side in FIG. 9) is formed with the high resolution dither screen, which is the first gradation expression method, by using the developing portion 3*d* and the photosensitive member 4*d* (first photosensitive member). At the downstream side in the conveyance direction of the recording medium P of the patch group, a cyan patch group (third adjustment image) is formed with the low resolution dither screen, which is the second gradation expression method, by using the developing portion 3*c* and the photosensitive member 4*c* (second photosensitive member), which are different from the developing portion 3*d* and the photosensitive member 4*d*. Here, the patch group is the cyan patch on the lower left side in FIG. 9. The first color is black, and the first gradation pattern is the black patch group (first adjustment image) that is formed by using the first photosensitive member on the upper left side in FIG. 9. The second color is cyan, and the third gradation pattern is the cyan patch group (third adjustment image) that is formed by using the second photosensitive member on the lower left side in FIG. 9.

A yellow patch group (first adjustment image) is formed with the high resolution dither screen, which is the first gradation expression method, by using the developing portion 3*a* and the photosensitive member 4*a* (first photosensitive member). At the downstream side in the conveyance direction of the recording medium P of the patch group, a magenta patch group (third adjustment image) is formed with the low resolution dither screen, which is the second gradation expression method, by using the developing portion 3*b* and the photosensitive member 4*b* (second photosensitive member), which are different from the developing portion 3*a* and the photosensitive member 4*a*. Here, the first color is yellow, and the first gradation pattern is the yellow patch group (first adjustment image) that is formed by using the first photosensitive member and positioned at second from the left in the upper column in FIG. 9. The second color is magenta, and the third gradation pattern is the magenta patch group (third adjustment image) that is formed by using the second photosensitive member and positioned at second from the left in the lower column.

A magenta patch group (first adjustment image) is formed with the high resolution dither screen, which is the first gradation expression method, by using the developing portion 3*b* and the photosensitive member 4*b* (first photosensitive member). At the downstream side in the conveyance direction of the recording medium P of the patch group, a yellow patch group (third adjustment image) is formed with the lowre solution dither screen, which is the second gradation expression method, by using the developing portion 3*a* and the photosensitive member 4*a*, which are different from the developing portion 3*b* and the photosensitive member 4*b*. Here, the first color is magenta, and the first gradation pattern is the magenta patch group (first adjustment image) that is formed by using the first photosensitive member and positioned at third from the left in the upper column in FIG. 9. The second color is yellow, and the third gradation pattern is the yellow patch group (third adjustment image) that is formed by using the second photosensitive member and positioned at third from the left in the lower column.

A cyan patch group (first adjustment image) is formed with the high resolution dither screen, which is the first gradation expression method, by using the developing portion 3*c* and the photosensitive member 4*c* (first photosensitive member). At the downstream side in the conveyance direction of the recording medium P of the patch group, a black patch group (third adjustment image) is formed with the low resolution dither screen, which is the second gradation expression method, by using the developing portion 3*d* and the photosensitive member 4*d*, which are different from the developing portion 3*c* and the photosensitive member 4*c*. Here, the first color is cyan, and the first gradation pattern is the cyan patch group (first adjustment image) that is formed by using the first photosensitive member and positioned at fourth from the left in the upper column in FIG. 9. The second color is black, and the third gradation pattern is the black patch group (third adjustment image) that is formed by using the second photosensitive member and positioned at fourth from the left in the lower column.

Though the patch groups are described as the first adjustment image and the third adjustment image in the above description, the patch groups can also be used as the second adjustment image and the fourth adjustment image. More specifically, when the black patch group formed with the first gradation expression method and by using the first photosensitive member is the first adjustment image, the black patch group formed with the second gradation expression method and by using the first photosensitive member is the second adjustment image. In this case, when the cyan patch group formed by the second gradation expression method and by using the second photosensitive member is the third adjustment image, the cyan patch group formed by the first gradation expression method and by using the second photosensitive member is the fourth adjustment image.

Also, when the yellow patch group formed with the first gradation expression method is the first adjustment image, the yellow patch group formed with the second gradation expression method is the second adjustment image. In this case, when the magenta patch group formed by the second gradation expression method is the third adjustment image, the magenta patch group formed by the first gradation expression method is the fourth adjustment image.

Also, when the magenta patch group formed with the first gradation expression method is the first adjustment image, the magenta patch group formed with the second gradation expression method is the second adjustment image. In this case, when the yellow patch group formed by the second gradation expression method is the third adjustment image, the yellow patch group formed by the first gradation expression method is the fourth adjustment image.

Also, when the cyan patch group formed with the first gradation expression method is the first adjustment image, the cyan patch group formed with the second gradation expression method is the second adjustment image. In this case, when the black patch group formed by the second gradation expression method is the third adjustment image, the black patch group formed by the first gradation expression method is the fourth adjustment image.

In other words, the patch group of the high resolution dither screen, which is the first gradation expression method, formed on the upstream side in the conveyance direction of the recording medium P and the patch group of the low resolution dither screen, which is the second gradation expression method, formed on the downstream side in the conveyance direction of the recording medium P are prepared. In this case, the patch groups are so arranged that the patch groups of the identical color are not allocated at the identical position in the longitudinal direction of the photosensitive member or the developing sleeve (axial direction in FIG. 9).

With such a configuration, the identical position in the longitudinal direction on the developing portion 3 and the photosensitive member 4 for one color is not used continuously for the same color in the case of forming the patch groups of different gradation expression methods. Therefore, it is possible to print the patch group (second adjustment image) to be formed on the downstream side in the conveyance direction of the recording medium P with the various influences of the memory image otherwise caused by the photosensitive member 4 and the developing portion 3 being suppressed.

In the case where a certain color is successively arranged, the following problems may occur. For the formation of the patch group including a pattern of the low resolution dither screen, which is the second gradation expression method, the photosensitive member 4 and the developing portion 3 for one color that are used at the upstream side in the conveyance direction of the recording medium P that are used for forming the patch group of the first gradation expression method are used at the identical position in the longitudinal direction of the photosensitive member. Therefore, various influences of memory image caused by the photosensitive member 4 and the developing portion 3 may be exerted, but the arrangement of the example is free from such influences and enables printing the second patch groups for each of the colors.

The dither circuit 26 assigns 36 gradations in one patch group including the pattern of the high resolution dither screen, which is the first gradation expression method, among the entire 256 gradations of each of the patches based on the data output from the pattern generator 29 (pattern generating unit). In this case, the 36 gradations are mainly assigned to an area having low density.

In contrast, the output level of the laser driver 27 is so set that a smaller number of gradations are assigned to a high density region. With such a configuration, it is possible to well adjust the gradation characteristics particularly in a highlighted portion (bright area).

On the other hand, the 36 gradations are uniformly assigned to a reproducible density area level in the patch groups each including the pattern of low resolution dither screen, which is the second gradation expression method. However, it is necessary to set the output level of the laser driver 27 in such a manner that finer assignment is performed for a very low density area for the purpose of accurate checking at the start of increase of density. With such a configuration, it is possible to well adjust the gradation characteristics in the entire reproducible density area of the printer.

Also, in the color copying machine in the present exemplary embodiment, characters and line images are formed by the high resolution dither screen, while gradation images such as photographs are formed by the low resolution dither screen, and the gradation levels set for the test patterns are not necessarily be identical.

As described above, it is possible to perform the gradation correction by using the test pattern in the present exemplary embodiment, and the use of the test pattern in the present exemplary embodiment reduces the burden on the user in the case of performing control for adjustment of density gradation of an apparatus even when steps different from those of the present exemplary embodiment are performed.

Also, though the test print in the present exemplary embodiment has the three-column structure for the patch of each of the colors, which is not more than an example, and the number of columns may be 2, 4, or more. Further, though the patch of each of the colors has 36 gradations (3 columns×12 rows), this is not more than an example, too, and the number of gradations is not limited to 36.

Figure 11:
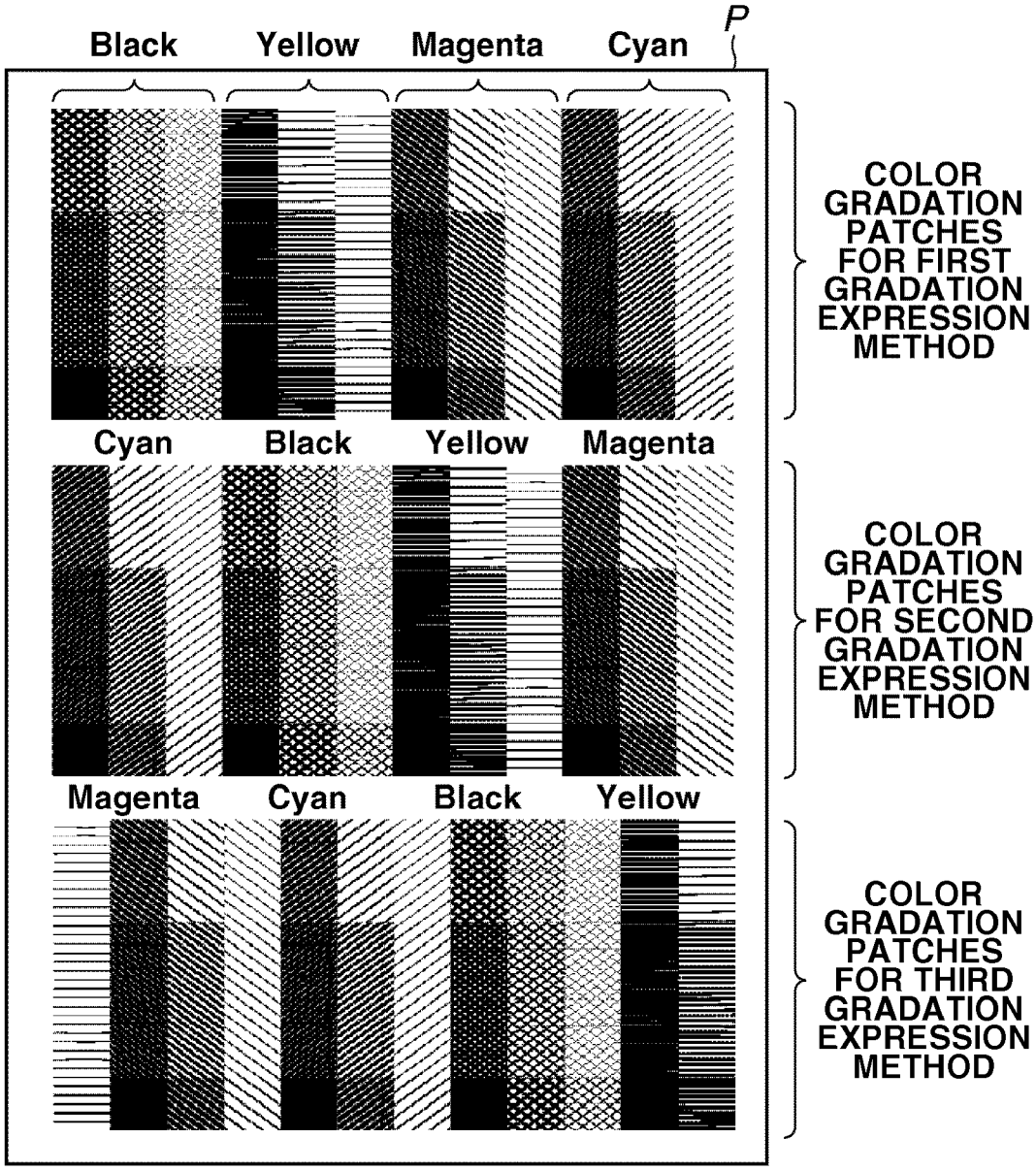
FIG. 11 is a diagram illustrating an example of a color test pattern image in the case of arranging three patch groups of color gradation patch pattern.
Figure 12:
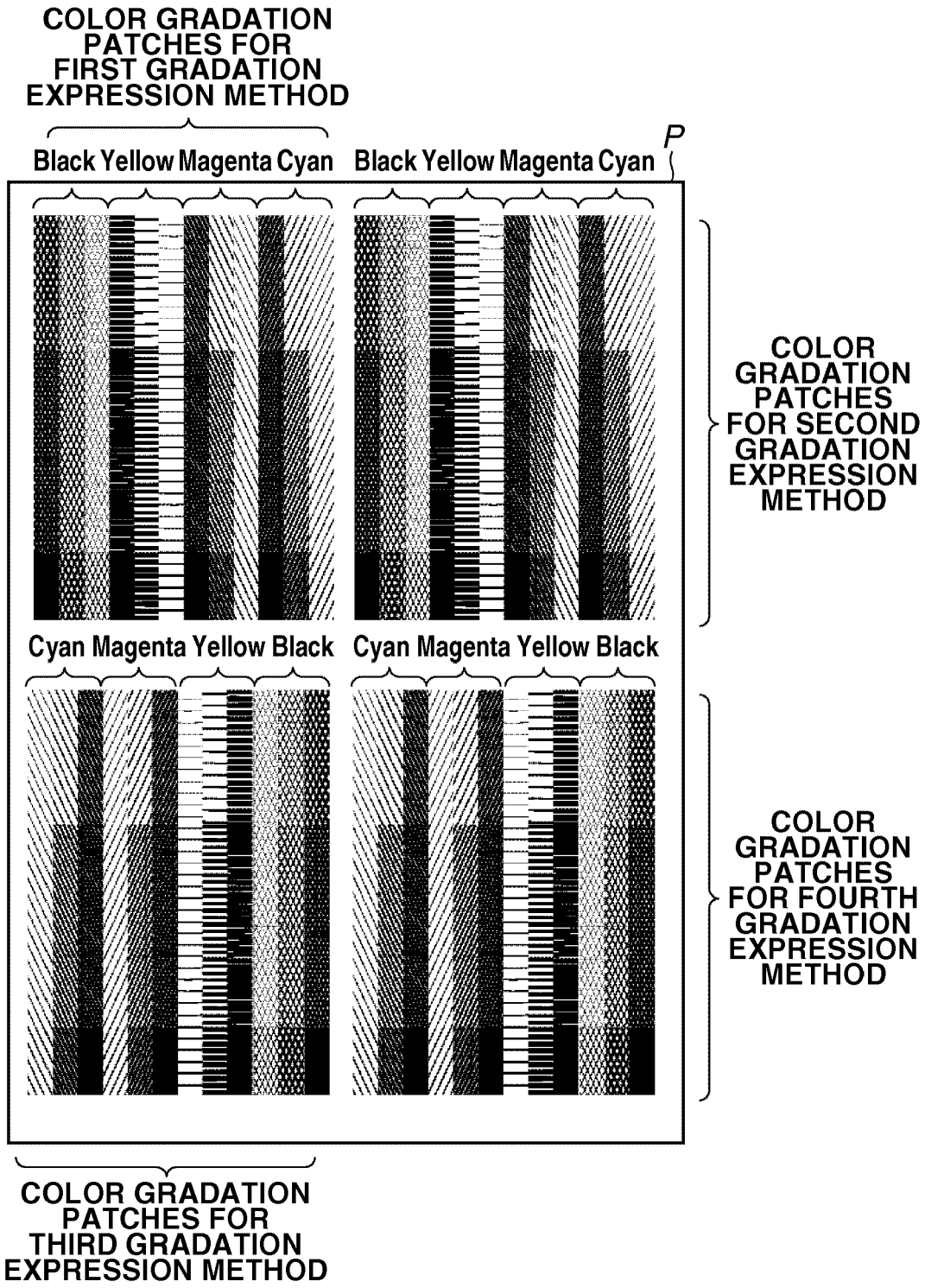
FIG. 12 is a diagram illustrating an example of a color test pattern image in the case of arranging four patch groups of color gradation patch pattern.

In the present exemplary embodiment, the patch groups of two gradation expression methods (dither screens) are arranged on one test print, but the gradation expression methods are not limited to the different two types. Patch groups of three types of gradation expression methods (dither screens) can be formed as illustrated in FIG. 11, and patch groups of four types of gradation expression methods (dither screens) can be formed as illustrated in FIG. 12, or more gradation expression methods can be employed. The patch of the gradation expression method formed on the upstream side in the conveyance direction of the recording medium P and the patch of the gradation expression method formed on the downstream side in the conveyance direction of the recording medium P are so arranged that an identical color is not allocated at an identical position in the longitudinal direction of the photosensitive member or the developing sleeve. With such a configuration, a similar effect can be achieved.

Accordingly, it is possible to suppress the influences of a memory image in the apparatus to be exerted on the test pattern in performing calibration as well as to reduce the number of test pattern sheets to be printed and discharged by the operator.

Further, when the color test pattern recorded on one recording medium is divided into an upstream side and a downstream side in the recording medium conveyance direction, the color arrangements of the color test patterns of the upstream side and the downstream side in the recording medium conveyance direction are reversed with respect to the recording medium conveyance direction. More specifically, as illustrated in FIG. 9, when the order of black, yellow, magenta, and cyan from the left is set in the upstream side, the order of black, yellow, magenta, and cyan from the right is set in the downstream side. With such a configuration, an algorithm for the apparatus to automatically determine the direction of the test pattern is simplified, and an algorithm for data rearrangement and calculation to be performed afterwards is simultaneously simplified regardless of the direction of the test pattern.

A second exemplary embodiment of the present invention based on the image processing apparatus according to the first exemplary embodiment will be described below. The image formation method and the control method are the same as or similar to those of the first exemplary embodiment, and a characteristic portion of a test pattern enabled by the control for adjusting density gradation of the apparatus will be mainly described.

The test pattern according to the present exemplary embodiment is as illustrated in FIG. 13. The test pattern has a color column arrangement different from that of the first exemplary embodiment. High density gradation patch columns of black, yellow, magenta, and cyan are firstly arranged, and lower density patch columns are arranged sequentially in the same color order with lowest density gradation patch columns being arranged lastly.

Alternatively, the arrangement illustrated in FIG. 14 can be employed. The arrangement has the same color column arrangement with the test pattern described with reference to FIG. 12. The columns of close density levels of each of the colors are cyclical but arranged at random.

With such a configuration, the gradation correction processing in a wider area of the photosensitive member can be performed. However, since a difference can occur due to gradation shift at a connection part of patch columns, it is necessary to optimize the smoothing processing at the connection part depending on the apparatus.

Thus, according to the second exemplary embodiment, though the difference due to the gradation shift may occur at the connection part of patch columns as compared to the first exemplary embodiment, it is possible to perform the gradation correction processing on the entire plane, thereby enabling optimization of the gradation of the entire plane.

A third exemplary embodiment of the present invention based on the image processing apparatus according to the first and second exemplary embodiments will be described below. The image formation method and the control method are the same as those of the first and second exemplary embodiments or based on a concept similar to those of the first and second exemplary embodiments.

Figure 15:
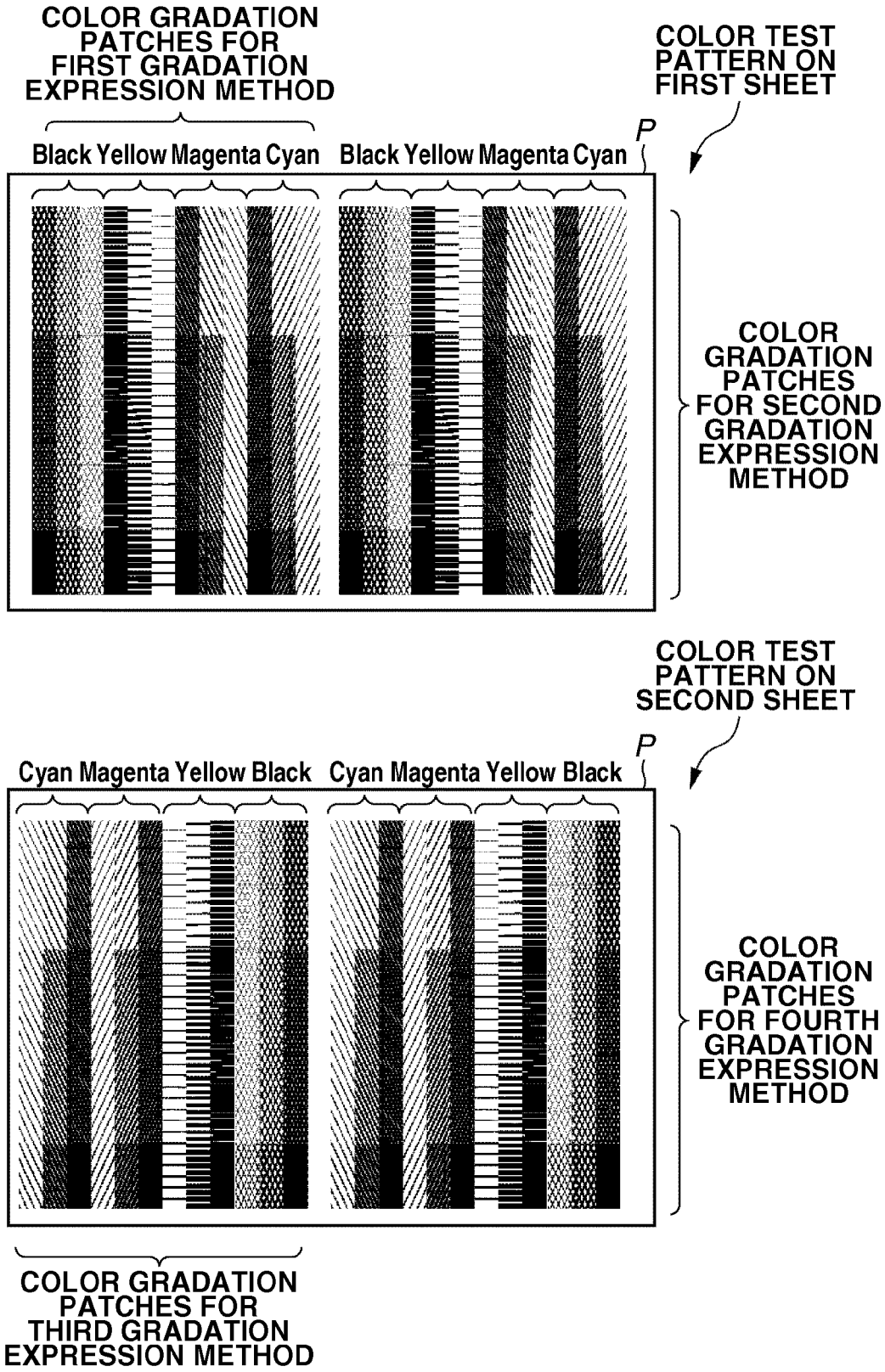
FIG. 15 is a diagram illustrating another combination of color test pattern images in the case of continuously outputting a color test pattern image over a plurality of recording sheets.
Figure 16:
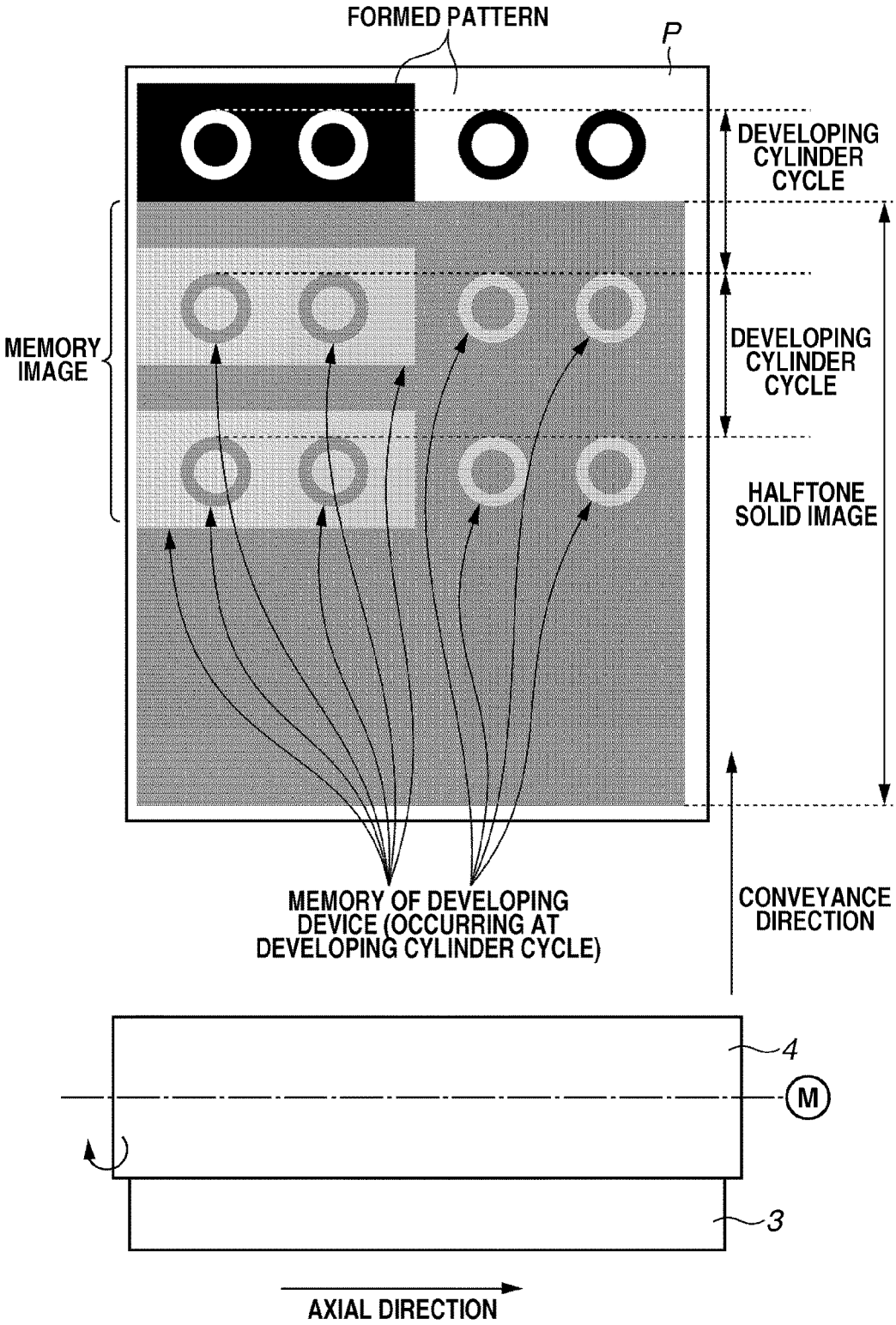
FIG. 16 is a diagram illustrating an example of a memory image at a developing portion in an image forming apparatus using electrophotographic technology.

As illustrated in FIGS. 14 and 15, in the case of an image forming apparatus wherein color test patterns are printed on a plurality of recording sheets to be sequentially output, the image forming apparatus has the structure of not allocating adjustment patch images of an identical color at an identical position in the recording medium conveyance direction.

Here, patterns of a first gradation expression and a second gradation expression are formed on a first recording medium, and patterns of a third gradation expression and a fourth gradation expression are formed on a second recording medium. The patches of the gradation expression method formed on the downstream side in the conveyance direction of the first recording medium and the patches of the gradation expression method formed on the upstream side in the conveyance direction of the second recording medium are so arranged that an identical color is not allocated at an identical position in the longitudinal direction of the photosensitive member and the developing sleeve. With such a configuration, it is possible to achieve a similar effect.

The present exemplary embodiment is effective when it is necessary to print many color test patterns and the test patterns cannot be contained in one recording sheet. Also, the present exemplary embodiment is effective in the case where there is a combination of gradation expression methods that cannot be arranged on one recording sheet due to a certain limitation of the printer control unit.

With such a configuration, it is possible to suppress the influences of the test pattern recorded on the first sheet to be exerted on the second test pattern even when the sheet interval is shortened.

Though the image bearing member is a recording medium, which is a transfer sheet, in the foregoing description, the image bearing member can be an intermediate transfer member. The above exemplary embodiments are applicable to such case by changing the detection unit to a sensor for reading a test pattern formed on the intermediate transfer member.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Applications No. 2008-165072 filed Jun. 24, 2008 and No. 2009-145443 filed Jun. 18, 2009, which are hereby incorporated by reference herein in their entirety.

What is claimed is:

1. An image forming apparatus comprising:

an image forming unit including a photosensitive member, an exposure unit configured to form a latent image on the photosensitive member, and a developing unit configured to develop the latent image formed on the photosensitive member with toner, and configured to transfer a toner image developed on the photosensitive member to an image bearing member conveyed in a direction orthogonal to a longitudinal direction of the photosensitive member; and, a control unit configured to cause the image forming unit to form detecting images including pattern images of a plurality of densities on the image bearing member to adjust gradation of the toner image formed on the photosensitive member by the image forming unit, wherein the control unit causes the image forming unit to form a first detecting image and a second detecting image on the image bearing member, a density range of the first detecting image defined by a pattern image of the maximum density and a pattern image of the minimum density included in the first detecting image at least partially matches a density range of the second detecting image defined by a pattern image of the maximum density and a pattern image of the minimum density included in the second detecting image, and the control unit causes the image forming unit to form the first detecting image and the second detecting image at different positions in the longitudinal direction and at different positions on the image bearing member in the direction orthogonal to the longitudinal direction.

2. The image forming apparatus according to claim 1, wherein the image forming unit includes a first photosensitive member and a second photosensitive member as the photosensitive member, and wherein the control unit causes the image forming unit to form the first detecting image and the second detecting image on the first photosensitive member to adjust gradation of the toner image formed on the first photosensitive member by the image forming unit and to form a third detecting image on the second photosensitive member, the third detecting image including pattern images of a plurality of densities to adjust gradation of the toner image formed on the second photosensitive member by the image forming unit, and wherein the control unit causes the image forming unit to form the third detecting image so that at least a part of the third detecting image is formed at a same position in the longitudinal direction as the second detecting image on the image bearing member and at a same position in the direction orthogonal to the longitudinal direction as the first detecting image on the image bearing member.

3. The image forming apparatus according to claim 1, wherein the image forming unit includes a first photosensitive member and a second photosensitive member as the photosensitive member, and wherein the control unit causes the image forming unit to form the first detecting image and the second detecting image on the first photosensitive member to adjust gradation of the toner image formed on the first photosensitive member by the image forming unit and to form a third detecting image and a fourth detecting image on the second photosensitive member, the third and fourth detecting images including pattern images of a plurality of densities to adjust gradation of the toner image formed on the second photosensitive member by the image forming unit, and a density range of the third detecting image defined by a pattern image of the maximum density and a pattern image of the minimum density included in the third detecting image at least partially matches a density range of the fourth detecting image defined by a pattern image of the maximum density and a pattern image of the minimum density included in the fourth detecting image, wherein the control unit causes the image forming unit to form the third detecting image so that at least a part of the third detecting image is formed at a same position in the longitudinal direction as the second detecting image on the image bearing member and at a same position in the direction orthogonal to the longitudinal direction as the first detecting image on the image bearing member, and wherein the control unit causes the image forming unit to form the fourth detecting image so that at least a part of the forth detecting image is formed at a same position in the longitudinal direction as the first detecting image on the image bearing member and at a same position in the direction orthogonal to the longitudinal direction as the second detecting image on the image bearing member.

4. The image forming apparatus according to claim 1, wherein the image bearing member is a recording medium.

5. The image forming apparatus according to claim 1, wherein the first detecting image is transferred on a first recording medium as the image bearing member, and the second detecting image is transferred on a second recording medium, as the image bearing member, that is conveyed subsequently to the first recording medium.

6. The image forming apparatus according to claim 2, wherein the image bearing member is a recording medium.

7. The image forming apparatus according to claim 3, wherein the image bearing member is a recording medium.

8. The image forming apparatus according to claim 2, wherein the first detecting image and the third detecting image are transferred on a first recording medium as the image bearing member, and the second detecting image is transferred on a second recording medium, as the image bearing member, that is conveyed subsequently to the first recording medium.

9. The image forming apparatus according to claim 3, wherein the first detecting image and the third detecting image are transferred on a first recording medium as the image bearing member, and the second detecting image and the forth detecting image are transferred on a second recording medium, as the image bearing member, that is conveyed subsequently to the first recording medium.

10. The image forming apparatus according to claim 1, wherein the image forming unit forms the toner image and detecting images in any one of a plurality of image forming modes, and wherein the image forming unit forms the first detecting image on the image bearing member in a first image forming mode and forms the second detecting image on the image bearing member in a second image forming mode.

11. The image forming apparatus according to claim 10, wherein the toner image with higher image quality is formed in the first image forming mode than in the second image forming mode.

12. The image forming apparatus according to claim 10, wherein the toner image is formed based on a first dither pattern in the first image forming mode or a second dither pattern in the second image forming mode, the first detecting image is formed based on the first dither pattern, and the second detecting image is formed based on the second dither pattern.

13. The image forming apparatus according to claim 2, wherein the image forming unit forms the toner image and detecting images in any one of a plurality of image forming modes, and wherein the image forming unit forms the first detecting image and the third detecting image on the image bearing member in the first image forming mode and forms the second detecting image on the image bearing member in the second image forming mode.

14. The image forming apparatus according to claim 13, wherein the toner image with higher image quality is formed in the first image forming mode than in the second image forming mode.

15. The image forming apparatus according to claim 13, wherein the toner image is formed based on a first dither pattern in the first image forming mode or a second dither pattern in the second image forming mode, the first detecting image is formed based on the first dither pattern, and the second detecting image is formed based on the second dither pattern.

16. The image forming apparatus according to claim 3, wherein the image forming unit forms the toner image and detecting images by any one of a plurality of image forming modes, and wherein the image forming unit forms the first detecting image and the third detecting image on the image bearing member in the first image forming mode and forms the second detecting image and the fourth detecting image on the image bearing member in the second image forming mode.

17. The image forming apparatus according to claim 16, wherein the toner image with higher image quality is formed in the first image forming mode than in the second image forming mode.

18. The image forming apparatus according to claim 16, wherein the toner image is formed based on a first dither pattern in the first image forming mode or a second dither pattern in the second image forming mode, the first detecting image is formed based on the first dither pattern, and the second detecting image is formed based on the second dither pattern.

* * * * *